US006705237B2

(12) United States Patent
Moore, Jr. et al.

(10) Patent No.: US 6,705,237 B2
(45) Date of Patent: Mar. 16, 2004

(54) PLASTIC PALLET DESIGN

(75) Inventors: Roy E. Moore, Jr., Killingworth, CT (US); Ronald P. Brochu, Westbrook, CT (US); Daniel J. Swistak, Newmarket, NH (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 0 days.

(21) Appl. No.: 09/938,954

(22) Filed: Aug. 24, 2001

(65) Prior Publication Data

US 2002/0112653 A1 Aug. 22, 2002

Related U.S. Application Data

(60) Provisional application No. 60/227,537, filed on Aug. 24, 2000.

(51) Int. Cl.[7] ..... B65D 19/38
(52) U.S. Cl. ..... 108/57.25
(58) Field of Search ..... 108/51.11, 51.3, 108/901, 57.25, 57.26, 57.32, 56.1, 56.3

(56) References Cited

U.S. PATENT DOCUMENTS

| | | | | |
|---|---|---|---|---|
| 1,910,781 | A | | 5/1933 | Way |
| 2,544,657 | A | | 3/1951 | Cushman |
| 2,643,081 | A | * | 6/1953 | Spring |
| 2,699,912 | A | | 1/1955 | Cushman |
| 2,828,933 | A | | 4/1958 | De Pew et al. |
| 2,908,464 | A | | 10/1959 | Traudt et al. |
| 2,925,978 | A | | 2/1960 | Marso |
| 2,991,965 | A | | 7/1961 | Drieborg |
| 3,126,843 | A | | 3/1964 | De Laney |
| 3,152,693 | A | | 10/1964 | Anderson |
| 3,187,689 | A | | 6/1965 | Hess |
| 3,267,884 | A | * | 8/1966 | Lessheim |
| 3,307,504 | A | | 3/1967 | Cloyd et al. |
| 3,380,403 | A | * | 4/1968 | Sullivan |
| 3,424,110 | A | | 1/1969 | Toot |
| 3,467,032 | A | | 9/1969 | Rowlands et al. |
| 3,481,285 | A | | 12/1969 | Yellin |
| 3,580,190 | A | | 5/1971 | Fowler |
| 3,602,157 | A | | 8/1971 | Cohen et al. |
| 3,603,272 | A | | 9/1971 | Ditges |
| 3,606,844 | A | | 9/1971 | Lubker, II et al. |
| 3,613,605 | A | | 10/1971 | Holdredge |
| 3,638,586 | A | | 2/1972 | Elshout |
| 3,640,229 | A | | 2/1972 | Bell |
| 3,651,769 | A | | 3/1972 | Foley |
| 3,654,874 | A | | 4/1972 | Skinner |
| 3,664,271 | A | | 5/1972 | Wolder et al. |
| 3,675,595 | A | | 7/1972 | Sullivan |
| 3,678,868 | A | | 7/1972 | Hirota |
| 3,680,495 | A | | 8/1972 | Pike |
| 3,680,496 | A | | 8/1972 | Westlake, Jr. |
| 3,683,823 | A | | 8/1972 | Schmid |
| 3,685,461 | A | | 8/1972 | Belcher |
| 3,685,463 | A | | 8/1972 | Francis |
| 3,699,901 | A | | 10/1972 | Cook, III |
| 3,699,902 | A | | 10/1972 | Allgeyer et al. |
| 3,710,733 | A | | 1/1973 | Story |

(List continued on next page.)

FOREIGN PATENT DOCUMENTS

| | | |
|---|---|---|
| DE | 27 33 457 | 2/1979 |
| WO | WO 90/01448 | 2/1990 |
| WO | WO 94/08861 | 4/1994 |

*Primary Examiner*—Jose V. Chen

(57) ABSTRACT

A pallet includes an upper deck, a support material disposed within the upper deck, an upper frame member supporting the upper deck, a plurality of foot members disposed on the upper frame member, and a lower frame member disposed on the plurality of foot members. The upper deck includes a first half and a second half disposed in communication with a major face of the first half. Numerous variations in which the pallet is collapsible or includes reinforcement members are within the scope of the pallet disclosed.

39 Claims, 26 Drawing Sheets

U.S. PATENT DOCUMENTS 3,720,176 A 3/1973 Munroe
3,757,704 A * 9/1973 Allgeyer et al.
3,759,194 A 9/1973 Fujii et al.
3,795,206 A 3/1974 Utz
D231,096 S 4/1974 Adam
3,814,031 A 6/1974 Fowler
D232,019 S 7/1974 Rehrig et et.
3,824,933 A 7/1974 Lind
3,835,792 A 9/1974 Wharton
3,868,915 A 3/1975 Hafner
3,878,796 A 4/1975 Morrison
3,916,803 A 11/1975 Garcia
3,917,066 A 11/1975 Cloyd
3,921,279 A 11/1975 Daley
3,938,448 A 2/1976 Nishitani et al.
3,964,400 A 6/1976 Brand
3,994,241 A 11/1976 Evans
4,002,126 A 1/1977 Bell et al.
4,013,021 A 3/1977 Steinlein et al.
4,051,787 A 10/1977 Nishitani et al.
D246,296 S 11/1977 Fujii et al.
4,103,857 A 8/1978 Levenhagen
4,133,270 A 1/1979 Ravera
4,146,205 A 3/1979 Skinner
4,159,681 A * 7/1979 Vandament
4,183,491 A 1/1980 Sanders et al.
4,220,100 A * 9/1980 Palomo et al.
4,287,836 A 9/1981 Aoki
4,316,419 A 2/1982 Cupido
4,359,948 A 11/1982 Judy et al.
4,403,555 A 9/1983 Forrest
4,597,338 A 7/1986 Kreeger
4,606,278 A 8/1986 Shuert
RE32,344 E 2/1987 Wind
4,735,154 A * 4/1988 Hemery
4,742,781 A 5/1988 Shuert
4,799,433 A 1/1989 Luft
4,843,976 A 7/1989 Pigott et al.
4,869,456 A 9/1989 Jacobs
4,951,821 A 8/1990 Kempkes
4,972,782 A 11/1990 Shepherd et al.
4,998,619 A 3/1991 Sowa et al.
5,042,396 A 8/1991 Shuert
5,046,434 A 9/1991 Breezer et al.
5,052,307 A * 10/1991 Morrison
5,094,175 A 3/1992 Christie
5,097,951 A 3/1992 Pigott et al.
5,117,762 A 6/1992 Shuert
5,154,286 A 10/1992 Gits
5,178,075 A * 1/1993 Kanazawa
5,195,439 A 3/1993 Harder
5,197,395 A 3/1993 Pigott et al.
5,205,221 A 4/1993 Melin et al.
D346,681 S 5/1994 Pigott et al.
D347,511 S 5/1994 Pigott et al.
5,337,681 A 8/1994 Schrage
5,343,814 A 9/1994 Pigott et al.
D354,606 S 1/1995 Pigott et al.
5,391,251 A 2/1995 Shuert
5,401,347 A 3/1995 Shuert
5,404,829 A 4/1995 Shuert
5,413,052 A * 5/1995 Breezer et al.
D364,030 S 11/1995 Pigott et al.
5,470,641 A 11/1995 Shuert
D370,763 S 6/1996 Pigott et al.
D371,882 S 7/1996 Kristoffersson
D372,192 S 7/1996 Pigott et al.
5,549,056 A 8/1996 Jordan et al.
5,551,353 A * 9/1996 Fiedler
5,555,820 A 9/1996 Shuert
5,566,624 A 10/1996 Brown et al.
5,579,686 A 12/1996 Pigott et al.
5,596,933 A 1/1997 Knight et al.
D378,458 S 3/1997 Pigott et al.
5,638,760 A 6/1997 Jordan et al.
5,666,886 A 9/1997 Alexander et al.
5,676,064 A 10/1997 Shuert
5,755,162 A 5/1998 Knight et al.
5,778,801 A 7/1998 Delacour
5,791,262 A 8/1998 Knight et al.
D398,731 S 9/1998 Pigott et al.
D398,732 S 9/1998 Pigott et al.
5,829,364 A * 11/1998 Urbach
5,836,255 A 11/1998 Uitz
5,845,588 A 12/1998 Gronnevik
5,868,080 A 2/1999 Wyler et al.
5,950,546 A 9/1999 Brown et al.
6,199,488 B1 3/2001 Favaron et al.
6,250,234 B1 6/2001 Apps
6,352,039 B1 * 3/2002 Woods et al.

* cited by examiner

Virginia Tech Load Test Summary

PLASTIC PALLET DESIGN

CROSS REFERENCE TO RELATED APPLICATION

This application claims the benefit of U.S. Provisional Patent Application Ser. No. 60/227,537 filed Aug. 24, 2000, the entire content of which is incorporated herein by reference.

TECHNICAL FIELD

This disclosure relates to a device for the transportation of packaged goods, and, more particularly, to a plastic pallet that meets certain standards set by the Grocery Manufacturers Association (GMA) and others for weight, durability, and strength.

BACKGROUND

Wooden pallets have long been the bane of any industry in which goods are shipped in packaged quantities, particularly in the packaging and transport industries. The typical wooden pallet comprises two decks arranged in a parallel planar relationship separated by two stringers and a center support member. The decks are spaced apart a sufficient distance so as to allow the prongs of a pallet jack, forklift, or similar lifting device to be positioned therebetween. The top deck can be a solid sheet of polywood or similar material. More often than not, the top deck is a series of slats spaced distance of usually one half to one inch from each other. The bottom deck is usually a series of slats similar to those of the top deck but spaced greater distances apart from each other to allow the wheels on the prongs of a pallet jack to be accommodated therebetween, thus allowing the pallet to be lifted with the lifting device.

In most of the wooden pallet designs, the stringers are positioned on opposing edges of the spaced-apart decks, thereby limiting lifting device access. The center support member is usually positioned parallel to and halfway between the stringers to provide support at the center of the top deck. The stringers typically contain cut outs or recessed areas on the lower edges that are positioned adjacent the bottom deck to limit the amount of wood needed to construct the pallet, thereby conserving weight. These cut outs or recessed areas are weak points at which the stringers may stress and crack or bend under the weight of a load positioned on the top deck. Cracking or bending of any of the various parts of the pallet puts the goods stacked on the pallet at risk for being spilled or damaged.

Pallets incorporating such a design are limited to being arranged on vertical racks or on a flooring surface in a single orientation that allows the lifting device to have access to a single pallet while having to manipulate the least number of pallets. In other words, because the pallet allows a lifting device access from only two sides, the arrangements of loaded pallets should be such that those two sides all face the same directions. To arrange loaded pallets in any other configuration would cause an unnecessary amount of pallets to have to be moved to gain access to one pallet surrounded by others.

Other wooden pallet designs comprise two decks configured as above but being separated by about nine blocks positioned therebetween as spacers. This design allows a lifting device to gain access from all four sides of the pallet. However, problems of stresses associated with the above-mentioned pallet design still exist and continue to present obstacles to the efficient use of this type of pallet in the packaging and transport industries.

In addition to the overall designs of wooden pallets, the material of fabrication itself poses problems for the industries that utilize the pallets. The useful lifetime of the typical wooden pallet is only about one year. In an era when "green is clean", the destruction of a natural resource, viz., trees, to fabricate pallets having a relatively short lifetime becomes an unpopular event that has come under fire from legislative bodies as a result of pressure exerted on politicians from environmental groups. After a certain amount of use, repair of a wooden pallet is futile and continued reparation becomes a cost-prohibitive factor in the pallet's maintenance. Millions of broken pallets are committed to waste every year, and, because many pallets have been contaminated with product that is not environmentally friendly, a large percentage of pallets must be destroyed as chemical waste.

Other problems associated with wooden pallets include handling difficulty due to their excessive weight and dimensional instability due to the ability of the wood to dry, crack, warp, swell, or rot. Furthermore, because the wood tends to absorb water, wooden pallets kept outside often become breeding grounds for undesirable fauna. Additionally, the various components of the wooden pallet are typically nailed or fastened together with similar implements, and pallet damage often results in the nails or fasteners being partially removed from the wood where they pose a potential hazard. In other instances, the nails or fasteners are completely removed from the wood only to be subsequently found in the tires of the lifting devices.

Plastic pallets provide an alternative to wooden pallets and are superior to the wooden pallets in many respects. The weight of the plastic pallet, however, remains a problem because of the need for significant amounts of reinforcement materials in the decks of the pallet to enable it to meet the load bearing capability of the wooden pallet, particularly when the loaded pallets are stored in racks where the pallet is supported only by rails at two edges and suspended therebetween. If both decks are reinforced, the weight requirement of the pallet is exceeded. Therefore, manufacturers of rackable plastic pallets currently limit the use of reinforcements to either the upper or lower deck. If the support is in the lower deck, the pallet often has difficulty passing the deflection limit specification while being lifted from the underside of the upper deck. It may also fail the deflection limit specification due to upper deck sag under static load, which can reduce fork lift gap size. If the support is placed only in the upper deck, the pallet will fail when lifted from below the lower deck or when riding on a chain conveyor system, which requires the lower deck to be rigid.

A new type of pallet is needed that overcomes the drawbacks of wooden pallets, yet meets the weight requirements as outlined by the GMA.

SUMMARY

A pallet is disclosed. The pallet includes an upper deck, a support material disposed within the upper deck, an upper frame member supporting the upper deck, a plurality of foot members disposed on the upper frame member, and a lower frame member disposed on the plurality of foot members. The upper deck includes a first half and a second half disposed in communication with a major face of the first half. Numerous variations in which the pallet is collapsible or includes reinforcement members are within the scope of the pallet disclosed.

In one embodiment, the pallet comprises: an upper deck configured from a support material, an upper frame member supporting the upper deck, a plurality of foot members disposed in physical contact with the upper frame member, and a lower frame member disposed in physical contact with the plurality of foot members. The upper deck is configured using at least two plates disposed in a spaced relationship except for a portion thereof where facing surfaces defining a surface of each of the at least two plates operably join to form a support element disposed between and connecting the at least two plates. The support element comprises at least two support members disposed between and normal to the at least two plates.

The above-described features and other features will be appreciated and understood by those skilled in the art from the following detailed description drawings, and appended claims.

BRIEF DESCRIPTION OF THE DRAWINGS

Referring now to the accompanying FIGURES, which are meant to be exemplary and not limiting.

DETAILED DESCRIPTION

Figure 1:
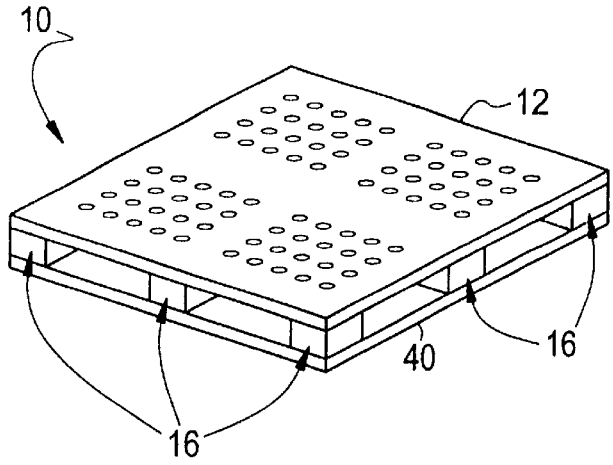
FIG. 1 is a perspective view of a plastic pallet.

A plastic pallet, an exemplary embodiment of which is shown generally at 10 in FIG. 1, comprises an upper deck 12 and a lower frame member 40 arranged in a parallel relationship and separated by foot members, shown generally at 16. Plastic pallet 10, hereinafter referred to as "pallet 10," is preferably configured and assembled to allow a pallet jack, fork lift, or a similar lifting device to gain access to the pallet from all four sides, thereby making the pallet compliant with the Grocery Manufacturers of America (GMA) guidelines. Upper deck 12 and lower frame member 40 are configured such that a plurality of pallets can be stacked on each other. Lower frame member 40 also preferably includes openings (not shown) to enable the wheels of the pallet jack or similar lifting device to engage the flooring surface to lift pallet 10. Variations on the componentry of pallet 10 include the disposing of reinforcement structures within the pallet substructure to provide support to pallet 10 and the filling of deck 12, foot members 16, and the reinforcement structures with a foam material to make the pallet more impact resistant. Further variations enable pallet 10 to be collapsed and reduced in height and/or disassembled for transport or storage.

Figure 2:
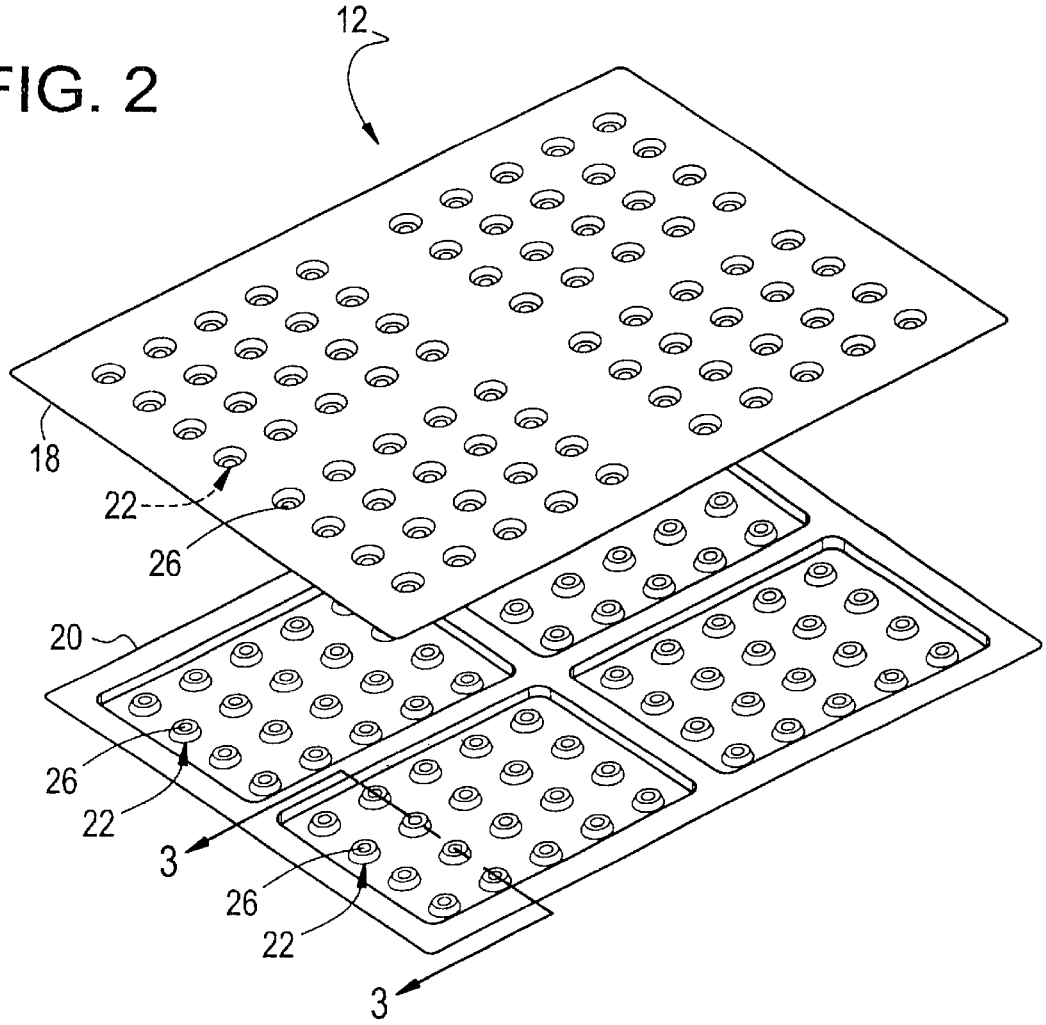
FIG. 2 is an exploded perspective view of an upper deck of a pallet.
Figure 3:
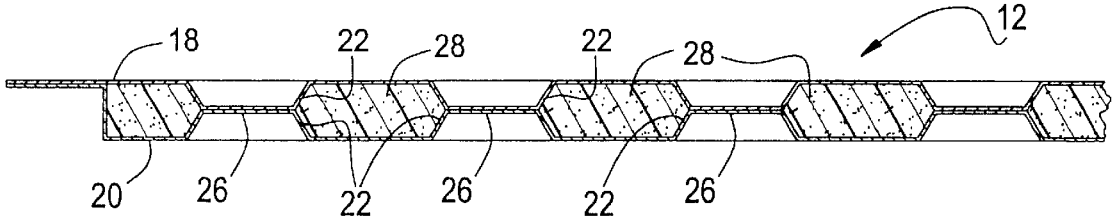
FIG. 3 is a side elevation sectional view of an upper deck of a pallet.

Referring to FIGS. 2 and 3, an exemplary embodiment of an upper deck of the pallet is shown generally at 12. Upper deck 12 is assembled from a first half 18 and a second half 20 attached or connected together such that a major surface of first half 18 can support a load (not shown) thereon and such that pallets can be stacked onto each other. Halves 18, 20 can be assembled to form upper deck 12 by any one of or a combination of various methods including, but not limited to, plastic stamping, welding (e.g., ultrasonic welding, hot plate welding, vibration welding, and similar techniques), thermo-forming (e.g., twin sheet thermo-forming, low temperature thermo-forming, and the like), and the like. Twin sheet thermo-forming of halves 18, 20 is a preferred technique due to the fact that both halves 18, 20 can be formed and connected in a single operational cycle of a thermo-forming apparatus (not shown), thereby substantially reducing the time required to fabricate and assembly halves 18, 20.

Both halves 18, 20 include frosto-conically shaped protrusions, shown generally at 22, disposed on the facing surface of each half 18, 20. Protrusions 22 include opening 26 disposed in the upper surface thereof. Openings 26 are dimensioned and configured to facilitate the passage of fluid between the opposing deck halves 18, 20 when upper deck 12 is fully assembled. The number of openings 26, as well as the opening geometry, is generally such that a desired percentage of open space is defined in upper deck 12. Although up to about 80% or so open space is possible, up to about 40% open space is preferred, with up to about 20% open space being more preferred. Also preferred is a configuration in which greater than or equal to about 5% open space is defined within upper deck 12, with greater than or equal to about 10% open space especially preferred.

When upper deck 12 is fully assembled, each protrusion 22 is preferably matable with a corresponding protrusion 22 on the opposing half 18, 20 at an upper surface of the frustum of protrusion 22 such that openings 26 in first half 18 register with openings 26 in second half 20. Corresponding protrusions 22 are joined via any suitable technique, including bonding, plastic stamping, welding, and/or thermo-forming to fixed first half 18 to second half 20.

Figure 4A:
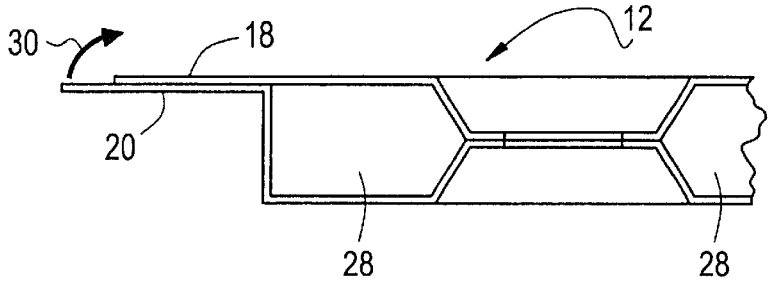
FIGS. 4A and 4D are side elevation sectional views of deck halves being crimped together.
Figure 4B:
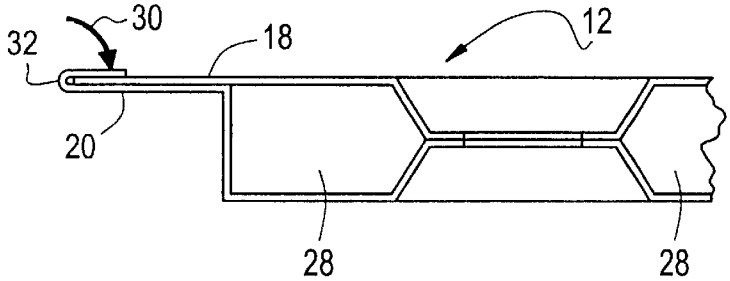
FIGS. 4E and 4F are side elevation sectional views of deck halves being retained on a pallet framework by a tab protruding from the framework.
Figure 4C:
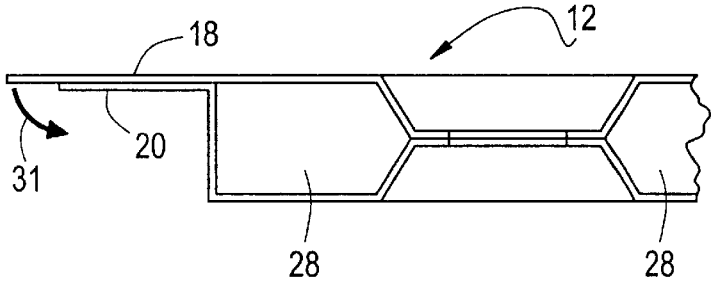
Figure 4D:
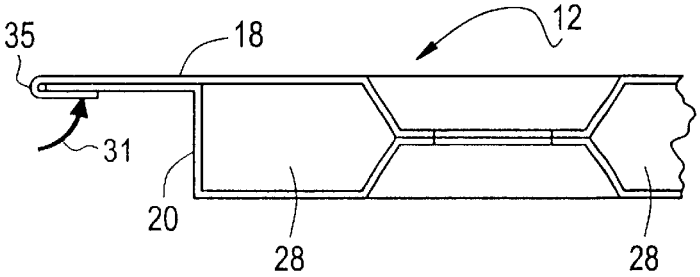

Alternately, protrusions 22 may be manually engaged with corresponding protrusions 22 with one or more mechanical connections such as fastening devices (e.g., screws nut and bolt assemblies, rivets, panel fasteners, or similar devices), snap joints, lap joints, and the like. An exemplary method of manually connecting halves 18, 20 of upper deck 12 together entails the crimping of the perimeter of one of the halves over the perimeter of the other half, as is illustrated in FIGS. 4A and 4B. In such a method, the perimeter of second half 20 extends beyond the perimeter of first half 18. The portion of second half 20 extending beyond the perimeter of first half 18 is bent over the perimeter of first half 18 in the direction of an arrow 30 and crimped or otherwise deformed such that first half 18 is retained on second half 20. The crimped edge, shown at 32 in FIG. 4B, protects the edges of upper deck 12 from impact. Alternately, as is shown in FIGS. 4C and 4D, the perimeter of first half 18 can extend beyond the perimeter of second half 20, and the portion of first half 18 extending beyond the perimeter of second half 20 can be bent in the direction of an arrow 31 and crimped or otherwise deformed such that second half 20 is retained on first half 18. The crimped edge, shown at 35 in FIG. 4D, like crimped edge 32 is shown in FIG. 4B, protects the edges of upper deck 12 from impact.

Figure 4E:
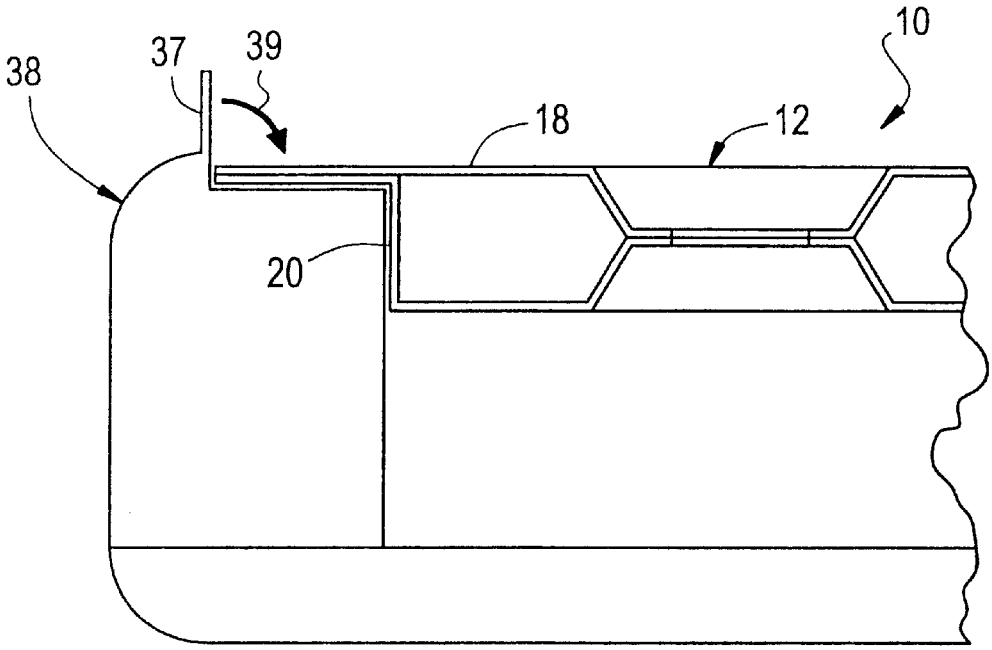
Figure 4F:
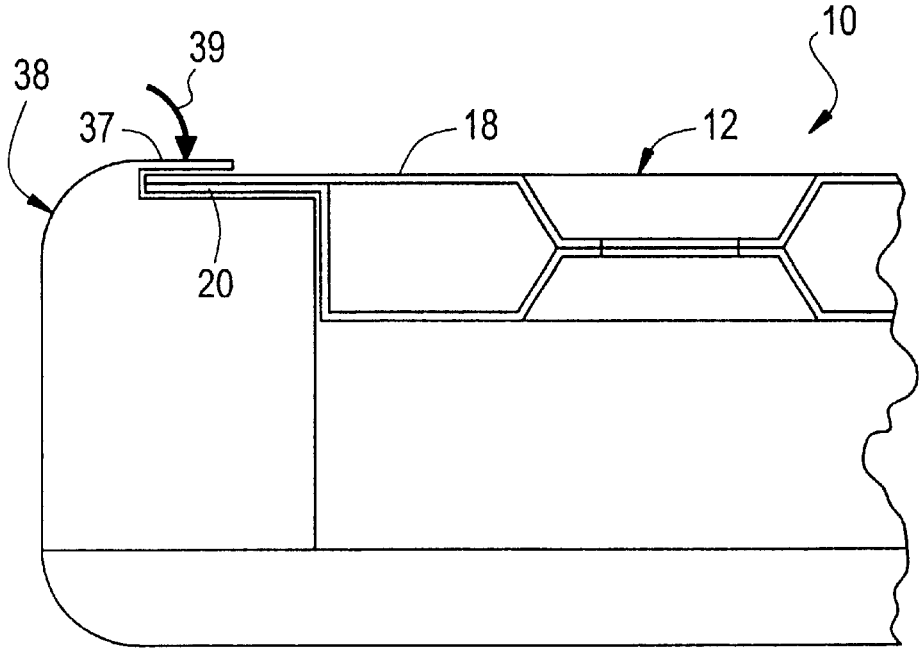

Yet another exemplary method of manually connecting deck halves 18, 20 is shown in FIGS. 4E and 4F. In FIG. 4E, deck halves 18, 20 are mounted within a shoulder in a substructure, shown generally at 38, of pallet 10. A tab 37 disposed on substructure 38 and protruding from the surface thereof can be bent in the direction of an arrow 39 over deck halves 18, 20 or otherwise deformed to enable deck 12 to be retained on substructure 38, as is shown in FIG. 4F.

Figure 5A:
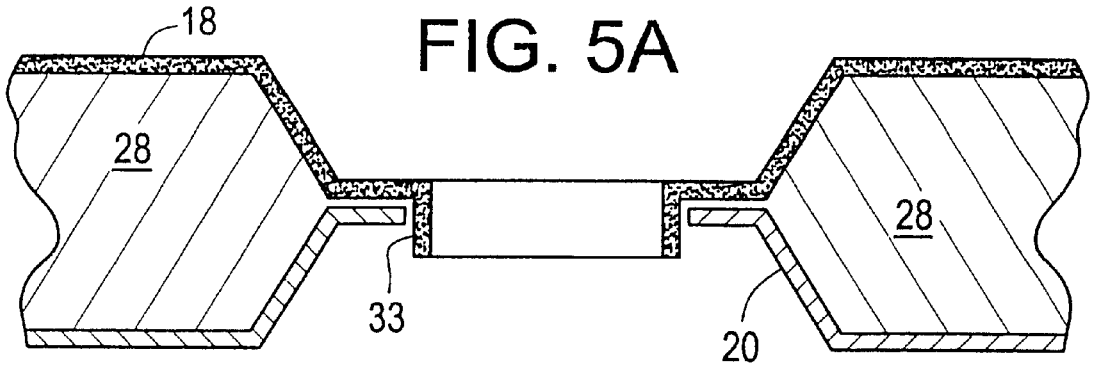
FIGS. 5A and 5B are side elevation sectional views of the attachment of protrusions in the upper and lower halves of an upper deck.
Figure 5B:
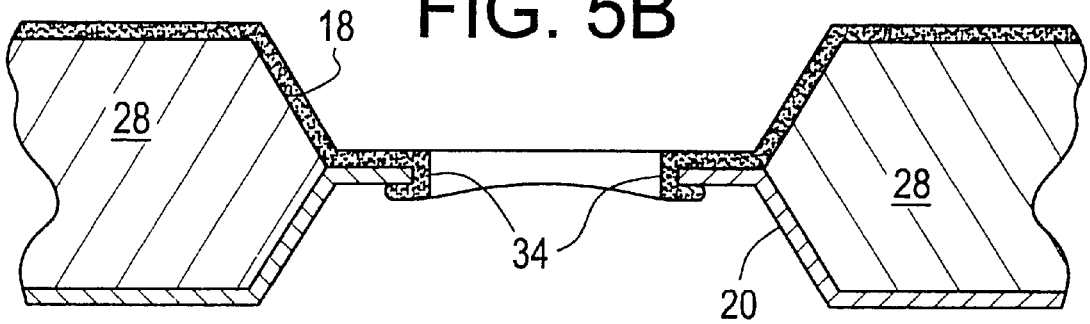

Another exemplary method of manually connecting deck halves 18, 20 involves configuring first half 18 to include a plug of material 33 that extends through the openings in second half 20, wherein the material 33 preferably extends through the openings to define an edge 34, as is shown in FIGS. 5A and 5B.

Figure 6:
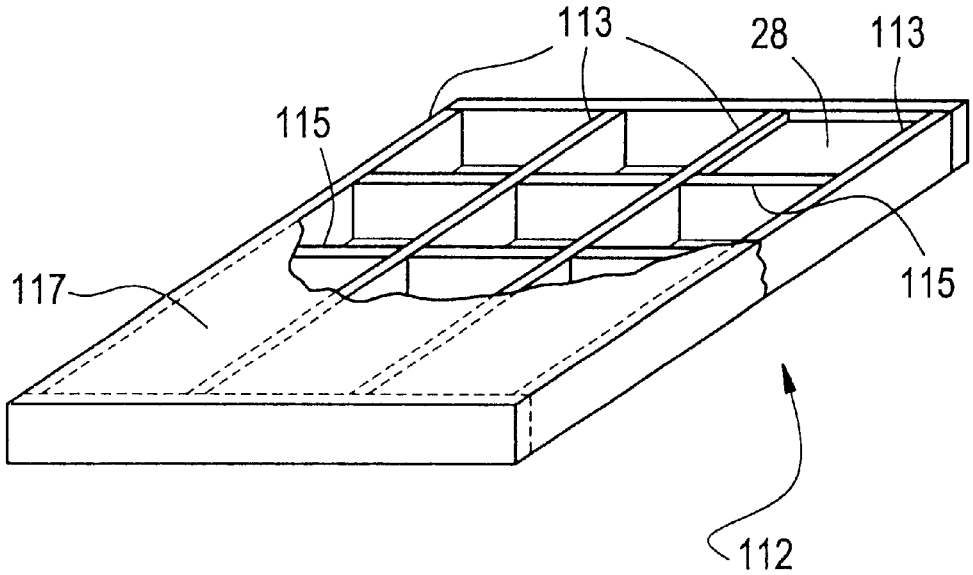
FIG. 6 is a perspective sectional view of a pallet.

Another exemplary embodiment of the upper deck is shown generally at 112 in FIG. 6. Upper deck 112 includes a skeletal sub-structure defined by ribs 113 and cross beams 115 arranged and supported by each other, as is shown. Ribs 113 are spaced parallel to each other and are traversed by cross beams 115 in a grid pattern arrangement. An integument 117 comprising a thin, puncture resistant film is disposed over at least one surface of the skeletal substructure of upper deck 112 and is preferably fused to ribs 113 and cross beams 115 to provide a surface upon which objects can be loaded. Integument 117 is configured and dimensioned to prevent or at least minimize the probability of penetration of the surfaces of upper deck 112 by sharp objects. Integument 117 may include a non-skid surface (not shown) embossed or calendared thereon, or it may include a non-skid film or layer attached thereto. The total non-skid surface cover of upper deck 112 can be up to and in excess of about 30% of strategically located non-skid material, with about 85% to about 100% coverage preferred, and 100% surface coverage of upper deck 112 being especially preferred. In other embodiments, upper deck 112 may be grated or perforated with holes to enable fluid communication to be maintained between the opposing surfaces thereof, thereby enhancing air circulation proximate objects loaded onto the pallet as well as the drainage of liquids.

In any embodiment, the upper deck may be slightly bowed out of its plane and in a direction opposite to the deflection of the pallet under load. The degree of bowing may be slight, for example, less than about one inch in a directional normal to the deck over the distance between opposing edges of the pallet. By incorporating a bow into the deck, the deflection of the pallet is compensated for upon loading, thereby imparting additional strength to the pallet.

Figure 7:
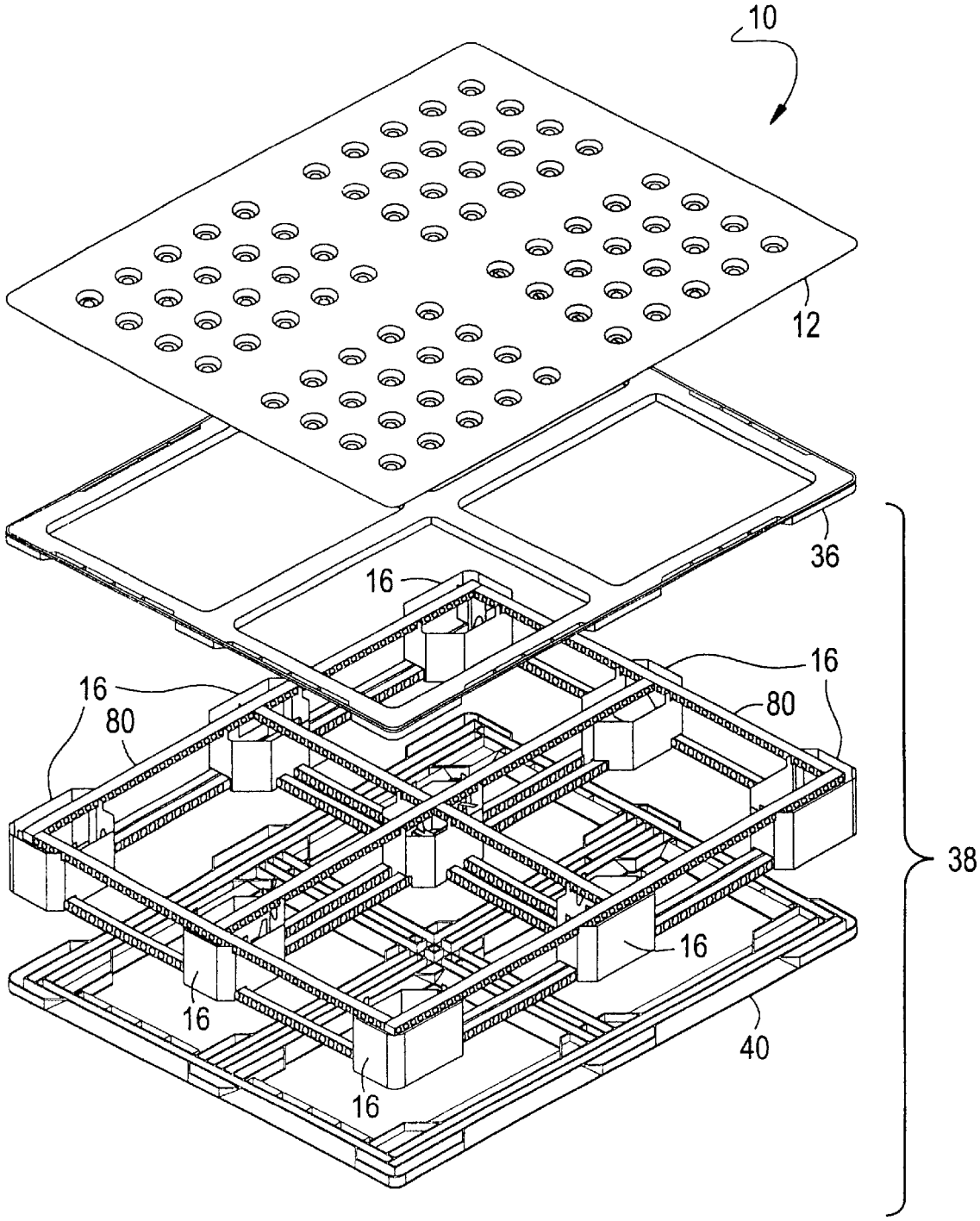
FIG. 7 is an exploded perspective view of a pallet.

Referring now to FIG. 7, an exploded view of pallet 10 is shown. Upper deck 12 is supported by an upper frame member 36, which, upon assembly of pallet 10, is centered over and supported by the framework or pallet substructure, one exemplary embodiment of which is shown in detail generally at 38. Pallet substructure 38 comprises foot members 16, reinforcement members 80, and lower frame member 40. Foot members 16 and reinforcement members 80 are arranged such that upper frame member 36 (and thus upper deck 12) is supported at the center of upper deck 12. Points intermediate each individual edge are also supported. Such an arrangement minimizes (or at least dramatically reduces) the deflection of upper deck 12 due to a load disposed thereon.

Figure 8A:
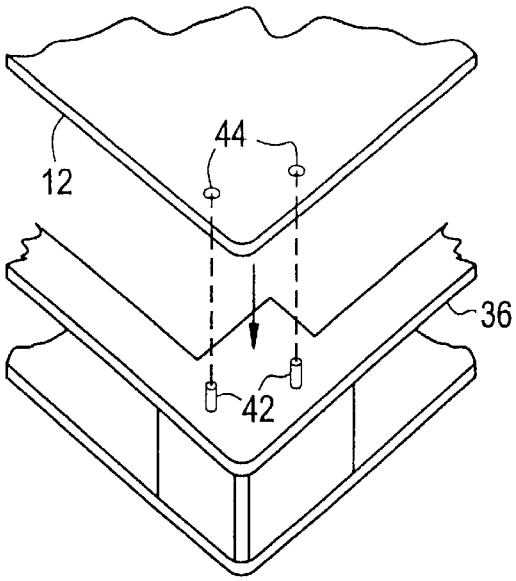
FIGS. 8A through 8D are perspective views of the attachment of an upper deck to an upper frame member.
Figure 8B:
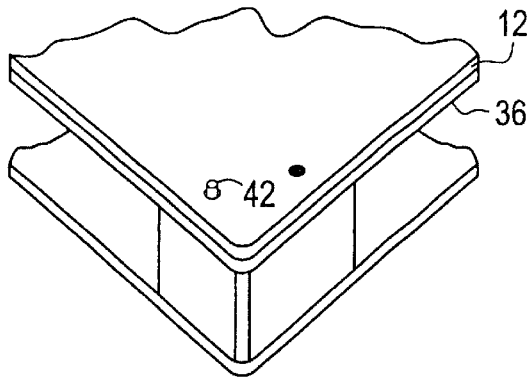

Upper deck 12 can be connected to upper frame member 36 via an arrangement of posts and receiving holes, as is shown in FIGS. 8A and 8B, or by an alternative adhesion or connecting method. As shown, upper frame member 36 includes a post 42 protruding normally from a surface thereof. Post 42 is dimensioned and positioned such that, upon receiving post 42 in a receiving hole 44 disposed in upper deck 12, upper deck 12 is aligned with upper frame member 36. Once post 42 is received in receiving hole 44, the portion of post 42 protruding through receiving hole 44 and extending above the surface of upper deck 12 is deformed with heat or pressure until it is sufficiently collapsed, thereby causing upper deck 12 to be retained on upper frame member 36.

Attachment of upper deck 12 to upper frame member 36 can further be accomplished via a number of bonding techniques. Such bonding techniques include, but are not limited to, ultrasonic welding, hot plate welding, hot air welding, vibration welding, and adhesive bonding.

Figure 8C:
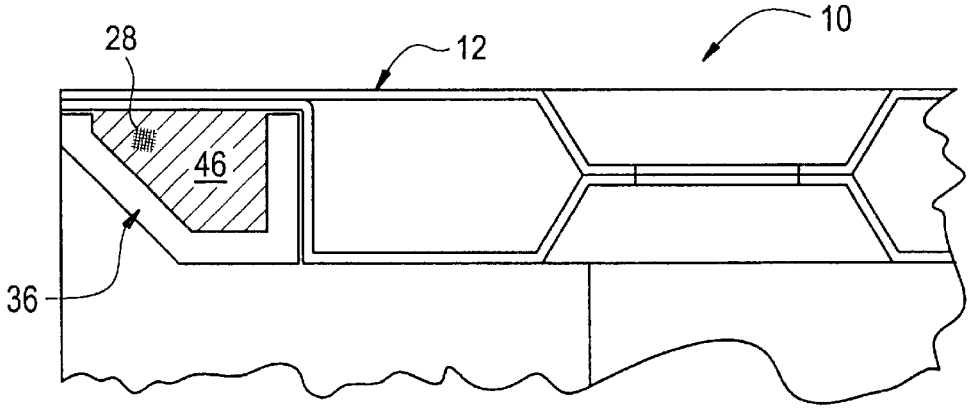
Figure 8D:
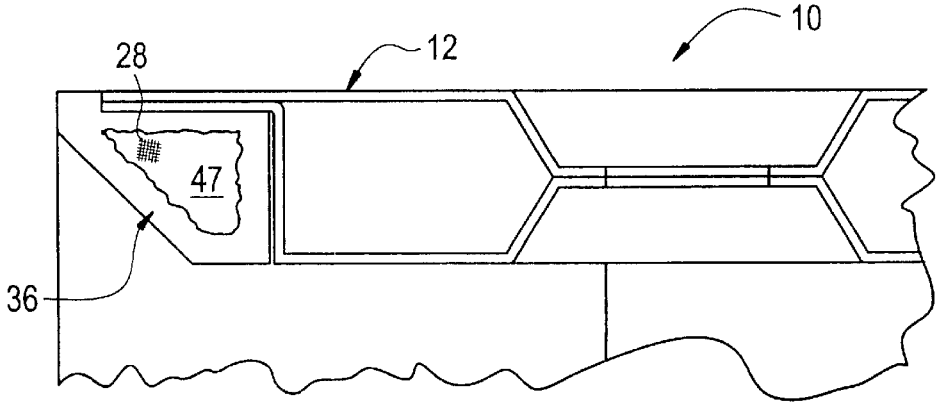

Upper frame member 36 can be configured to define a channel 46 about the perimeter of pallet 10, as is shown in FIG. 8C. Deck 12 is attached to upper frame member 36 using one of the above mentioned welding or adhesive bonding techniques such that channel 46 is sealed. Continuity of channel 46 enhances the perimeter integrity, thereby providing for improved protection from impact at the edges of deck 12. The lower frame member can be similarly configured to provide protection to the frame perimeter. Channel 46 can be configured to further enhance the structural integrity of the perimeter of deck 12 and the lower frame member by being aggressively ribbed, filled with a support material 28, or both. In another exemplary embodiment, as is shown in FIG. 8D, a closed cavity 47 may be formed by a gas assist injection molding process in which the mold geometry is designed such that a portion of upper frame member 36 (or the lower frame member) is evacuated through an injection of pressurized gas during mold filling. The formed cavity 47 could be left unfilled as the continuity of cavity 47 would enhance the perimeter integrity. Alternatively, cavity 47 could be filled with support material 28.

Referring back to FIG. 7, foot members 16 are described in greater detail. In FIG. 7, the positioning of foot members 16 as they are arranged on pallet 10 can be seen. Preferably, nine foot members 16 are arranged between frame members 36, 40 in a rectangular pattern of three rows, having three foot members 16 each, to allow the lifting device access to pallet 10 from all four sides. Generally, lifting devices have two forks protruding therefrom that can be accommodated on either side of the middle foot member 16 on any one side of pallet 10.

Foot members 16 are tubular structures that provide support for and space apart frame members 36, 40, thereby allowing the lifting devices to be inserted under deck 12. Foot members 16 may comprise any geometry capable of attaining the desired structural integrity, such as cylindrical, or they may be defined by at least two walls, the thickness of which may be variable depending upon weight restrictions and performance criteria of pallet 10. In particular, the thickness of the walls may be reduced in areas of foot members 16 less likely to receive an impact resulting from the insertion of a lifting device; alternately, the thickness of the walls may be increased in areas that are more likely to sustain an engagement with a lifting device. Support material, for example, foam as was described above, may be disposed within foot members 16 to further enhance the structural integrity thereof.

Figure 9:
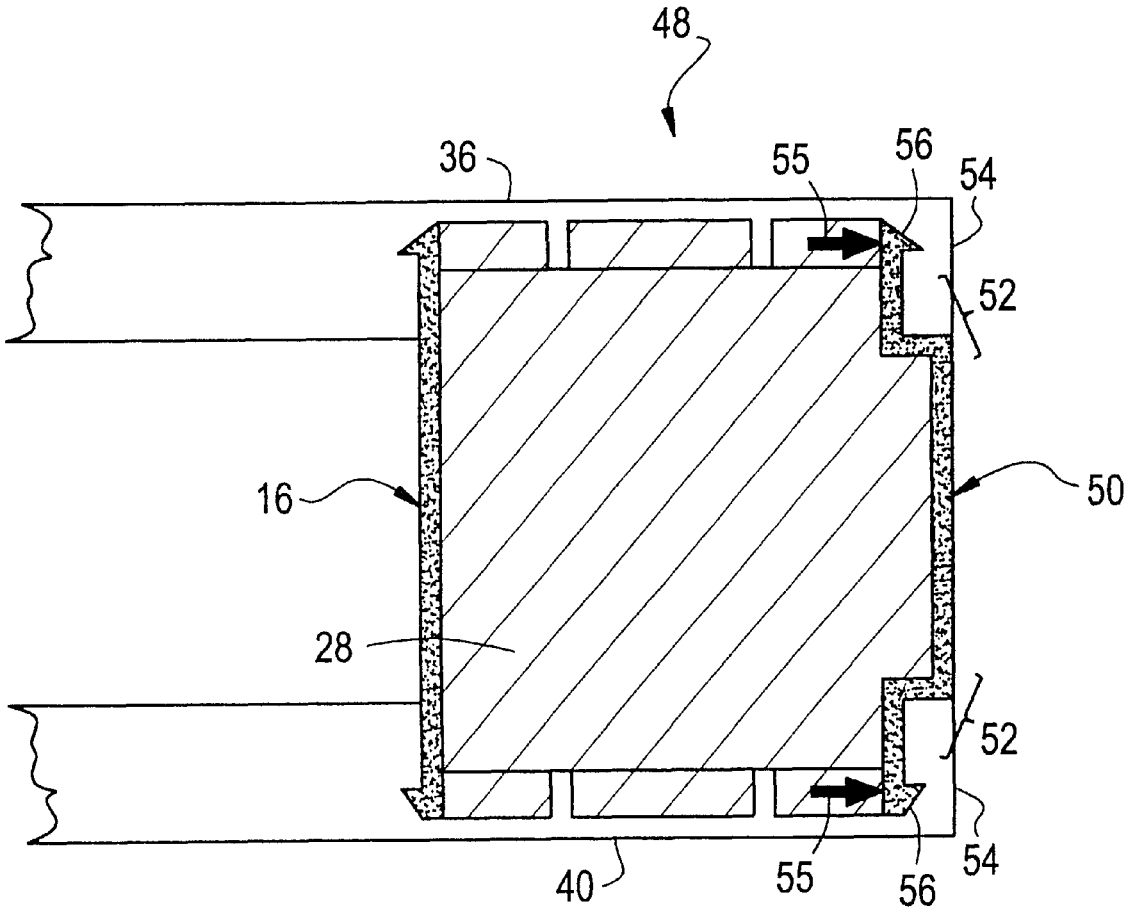
FIG. 9 is a side elevation sectional view of the attachment of a foot member to upper and lower frame members.

Foot members 16 may be fixed to frame members 36, 40 with a snap-fit joint, as is shown generally at 48 in FIG. 9. Snap-fit joint 48 provides an alternative to the welding and adhesive approaches referred to above. In snap-fit joint 48, the outer wall of foot member 16, one of which is shown generally at 50, is configured to include bends 52 disposed in the opposing upper and lower edge portions. Bends 52 are dimensioned to engage lips 54 formed at the perimeter edges of frame members 36, 40 such that the outer surfaces of bends 52 engage inner surfaces of lips 54. Prongs 56 disposed at the outer surfaces of bends 52 engage corresponding shoulder surfaces (not shown) disposed at lips 54. The filling of the structure defining foot member 16 with support material 28 biases the edge portions of outer wall 50 in the directions of arrows 55 such that the outer surfaces of bends 52 engage lips 54 and prongs 56 engage the shoulder surfaces, thereby causing foot members 16 to be fixedly retained between frame members 36, 40.

Figure 10A:
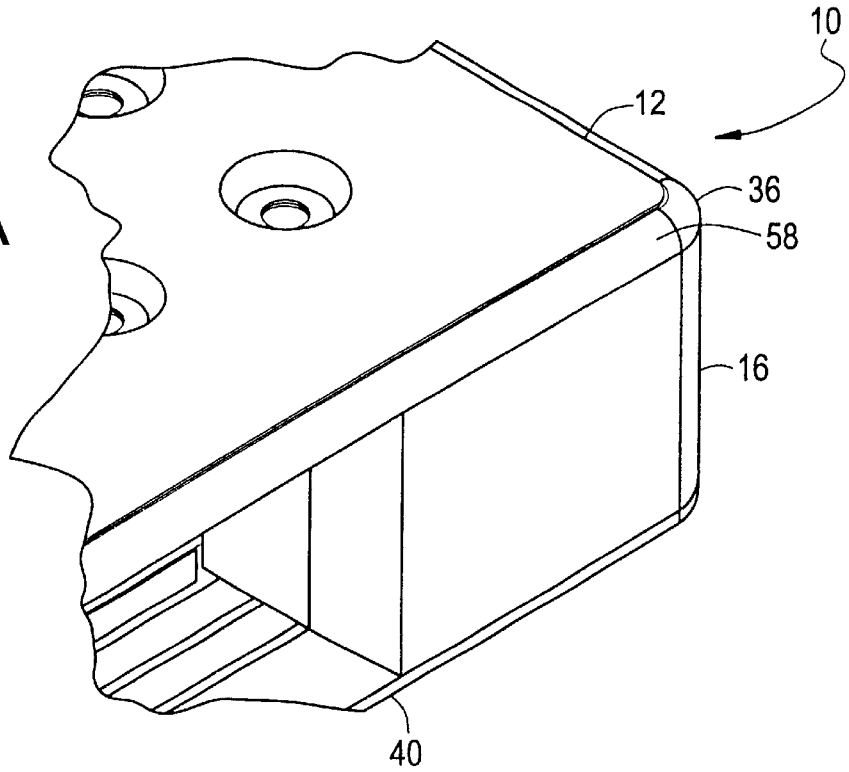
FIG. 10A is a perspective view of a foot member disposed between upper and lower frame members, the upper frame member having a rounded edge.
Figure 10B:
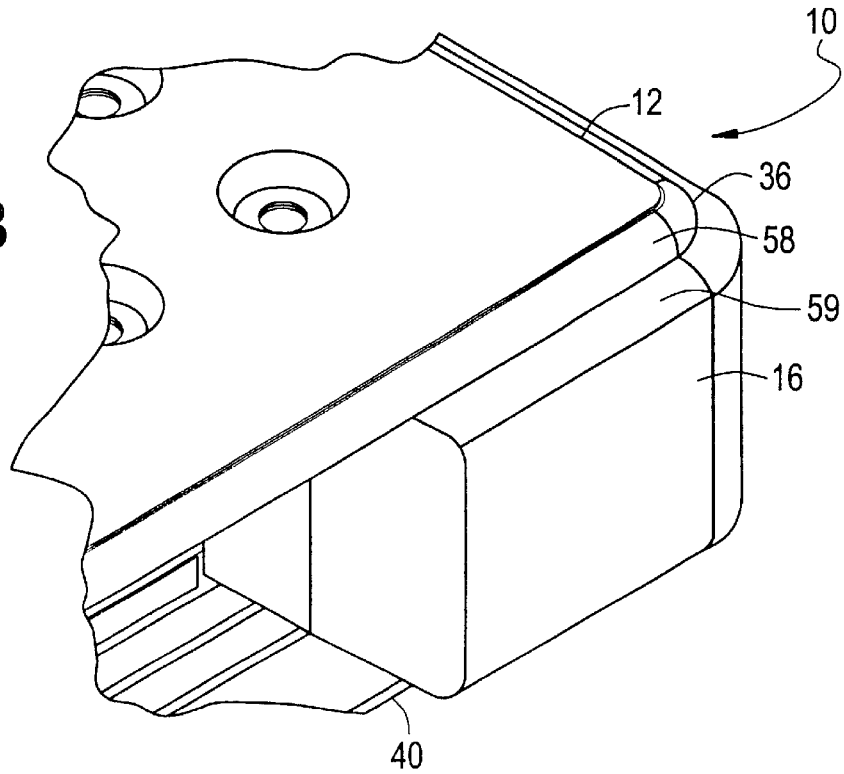
FIG. 10B is a perspective view of a foot member extending from between upper and lower frame members, the foot member having rounded edges.

Foot members 16 are located between frame members 36, 40 such that at least one edge thereof (in the case where foot members 16 are defined by discrete edges) is positioned to be flush with a corresponding edge of upper frame member 36, as is shown in FIG. 10A. Positioning of foot members 16 at such a location allows for an improved resistance to impact by allowing the load to be mutually absorbed by deck 12, lower frame member 40, and the outside perimeter of foot members 16. Positioning of the foot members to extend beyond the edges of upper frame member 36 (as is shown with reference to FIG. 10B), on the other hand, enables substantially the entire impact to be absorbed by foot members 16. Moreover, the edge of upper frame member 36, shown at 58 in FIG. 10A, can be rounded to provide impact deflection capabilities to pallet 10. The edge of foot member 16, shown at 59 in FIG. 10B, can also be rounded, thereby allowing foot member 16 to absorb substantially all of an impact to pallet 10. In either embodiment, radii added to the structure of pallet 10 in the areas susceptible to impact forces enables the impact to be deflected. Such a deflection of the impact forces reduces the amount of shock experienced by pallet 10 in everyday use.

Strengthening of the deck-to-foot assembly joint can also be effectuated by molding foot member 16 directly to frame members 36, 40. A strong joint maintained between foot member 16, frame members 36, 40, and associated deck 12 further contributes to the minimization of pallet deflection. The molding of foot member 16 into frame members 36, 40 is generally such that the half of foot member 16 is molded into the upper portion of the pallet, and the other half of foot member 16 is molded into the lower portion of the pallet. Upon assembly of the pallet, the interface between the upper and lower half of foot members 16 provides a point at which reinforcement can be introduced, thereby increasing the structural integrity of the pallet.

Figure 11:
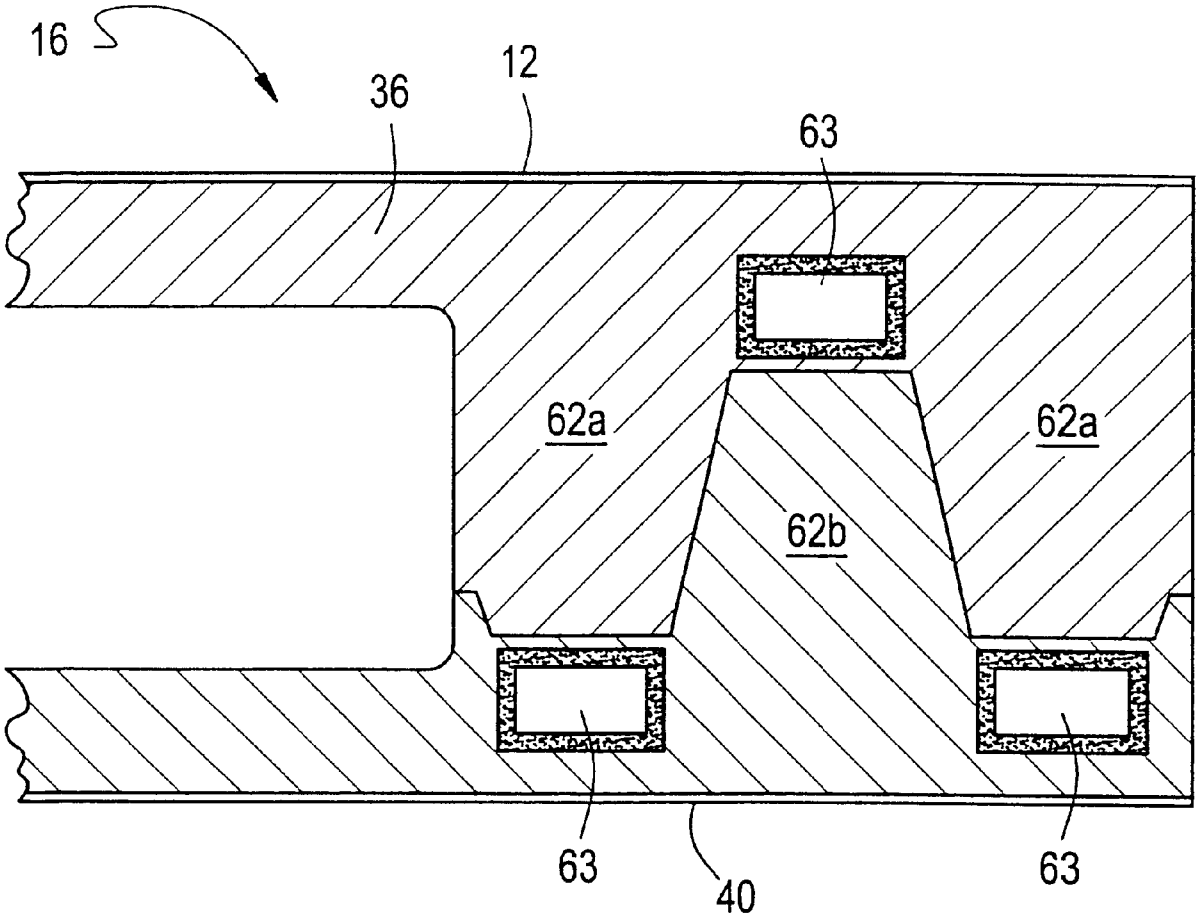
FIG. 11 is a side elevation sectional view of upper and lower frame members, each frame member having teeth that engage teeth on the opposing frame member.

An exemplary embodiment of the pallet in which foot member 16 is molded in halves into the supporting structure is shown in FIG. 11. Foot member 16 comprises engaging teeth depending from the surfaces of upper frame member 36 and from the surface of lower frame member 40. As shown, upper frame member 36 includes teeth 62*a* depending substantially normally from a lower surface of upper frame member 36. Teeth 62*a* are configured to receive teeth 62*b* extending substantially normally from an upper surface of lower frame member 40. Teeth 62*a*, 62*b* are dimensioned such that the teeth on either one of frame member 36, 40 are frictionally retained between the teeth on the other of frame member 36, 40, thereby maintaining a compressive fit between foot members 16 and frame members 36, 40 and minimizing the amount of pallet deflection under load. Teeth 62*a*, 62*b* may also be defined by various configurations to facilitate the fixed engagement of foot members 16 and frame members 36, 40. Such configurations include, but are not limited to, shiplaps, tongue-and-groove arrangements, and similar configurations. In any configuration, teeth 62*a*, 62*b* can be welded or adhesively joined to each other to provide added support and reinforcement to the pallet.

Foot member 16 may include reinforcement elements, exemplary embodiments of which are shown at 63, disposed adjacent to the base portions of teeth 62*a*, 62*b*. The resulting joints between the base portions of teeth 62*a*, 62*b* and reinforcement elements 63 provide sufficient structural support to restrict movement of reinforcement elements 63 out of the plane generally defined by deck 12 and upper and lower frame members 36, 40, thereby resulting in a substantially fixed condition in the direction of bending that significantly improves deflection resistance of the overall pallet assembly.

Figure 12A:
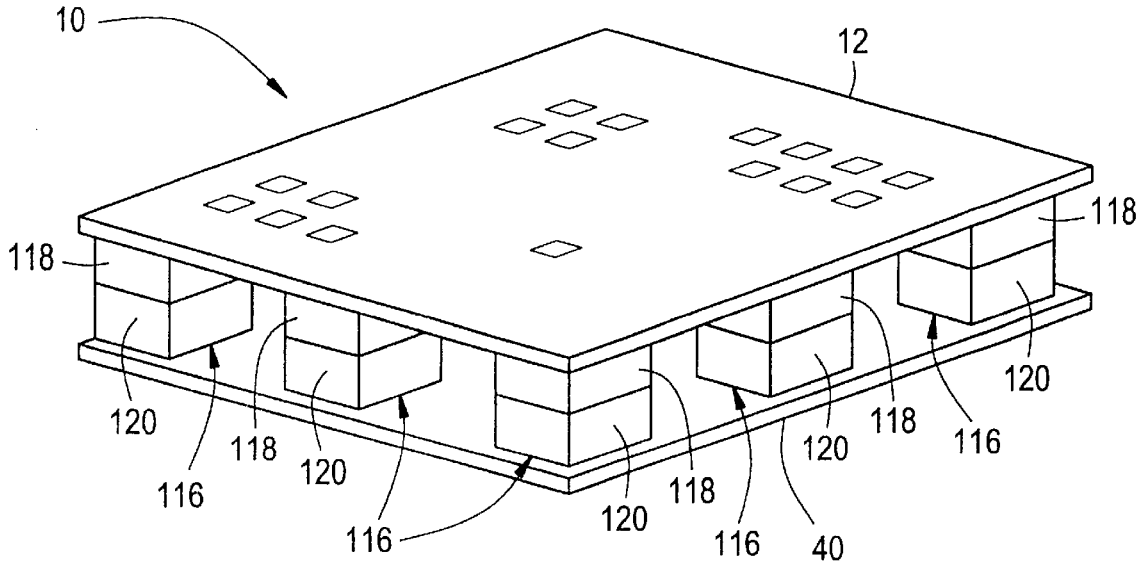
FIG. 12A is a perspective view of a collapsible pallet.

Referring now to FIGS. 2A through 12C, the collapsibility feature of pallet 10 is derived from the structure of collapsible foot members, shown generally at 116. As shown in FIG. 12A, when pallet 10 is in an uncollapsed state and ready for loading, lower frame member 40 is supported on the flooring surface, upper deck 12 is exposed, and a first foot half 118 and a second foot half 120 are disposed in contact with each other. Both first foot half 118 and second foot half 120 are tubular structures. When first foot half 118 engages second foot half 120 such that an edge of first foot half 118 is aligned with and is in direct contact with an edge of second foot half 120, foot member 116 is in an uncollapsed state.

Figure 12B:
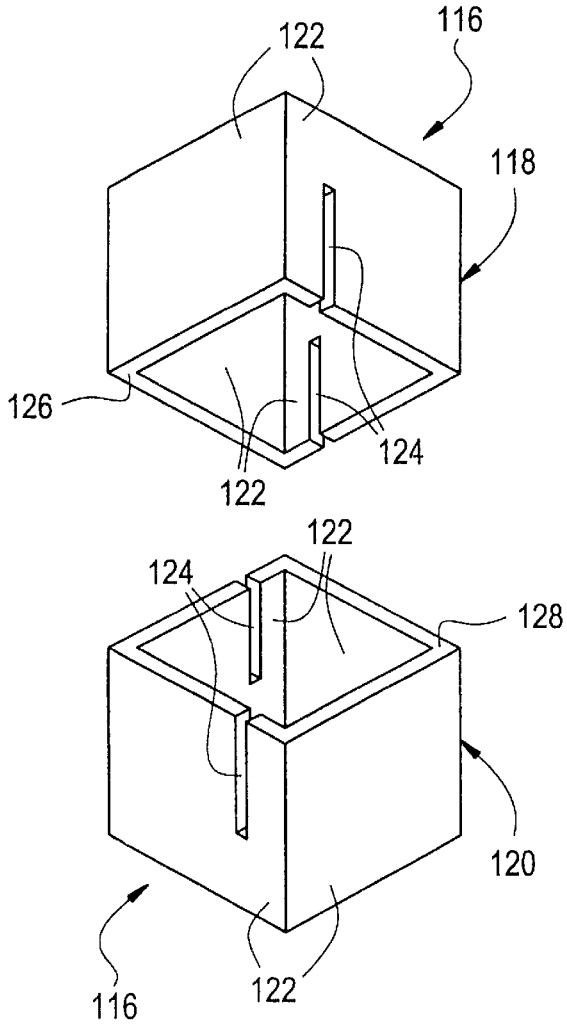
FIGS. 12B and 12C are perspective views of the engagement of the foot assemblies of the collapsible pallet of FIG. 12A.
Figure 12C:
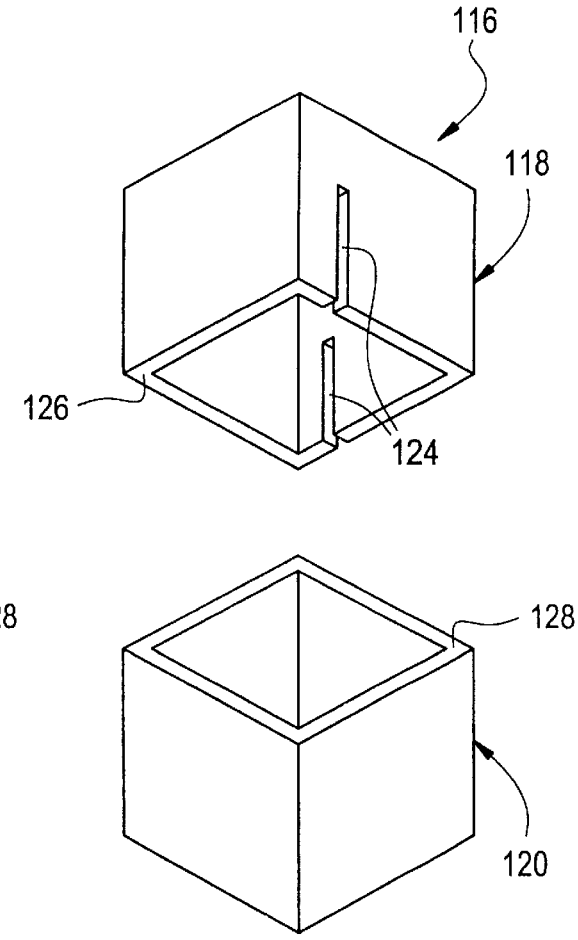

Referring to FIG. 12B, the structure of collapsible foot members 116 can be seen in greater detail. In particular, each first foot half 118 and each second foot half 120 is a tubular structure having at least one wall 122 and being open on opposing sides. Two slits 124 are cut into edges 126, 128 of each foot half 118,120 and are positioned such that slits 124 of first foot half 118 are engageable with slits 124 of second foot half 120. Slits 124 on opposing foot halves 118, 120 are dimensioned such that when first foot half 118 is mated with second foot half 120, the total required clearance for the collapsibility of the pallet is achieved. In an embodiment of foot member 116, as shown in FIG. 12C, slits 124 can be formed on only one of the foot halves 118, 120 and can be dimensioned to give the same amount of clearance.

Figure 13A:
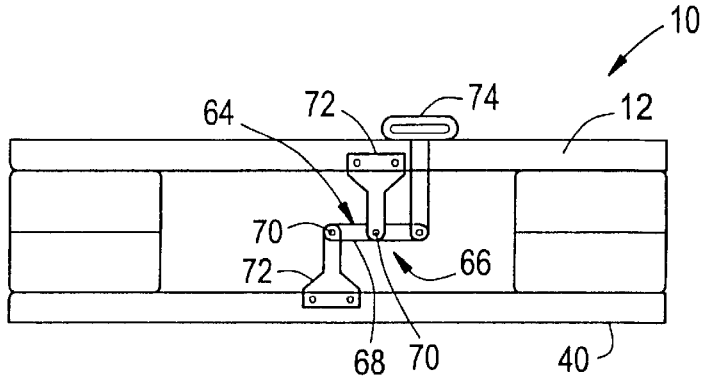
FIGS. 13A through 13C are side elevation view of a pallet being collapsed.
Figure 13B:
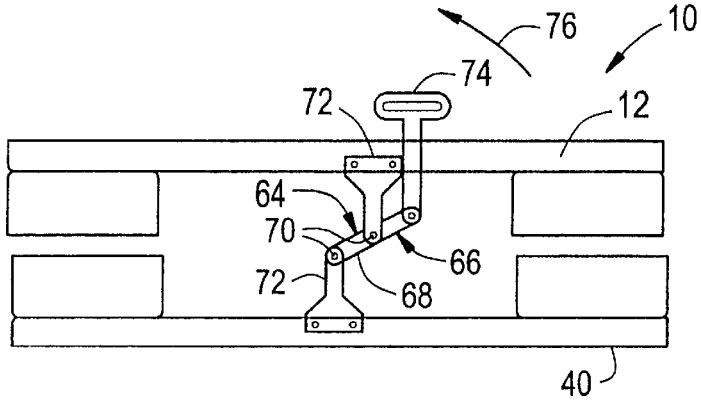
Figure 13C:
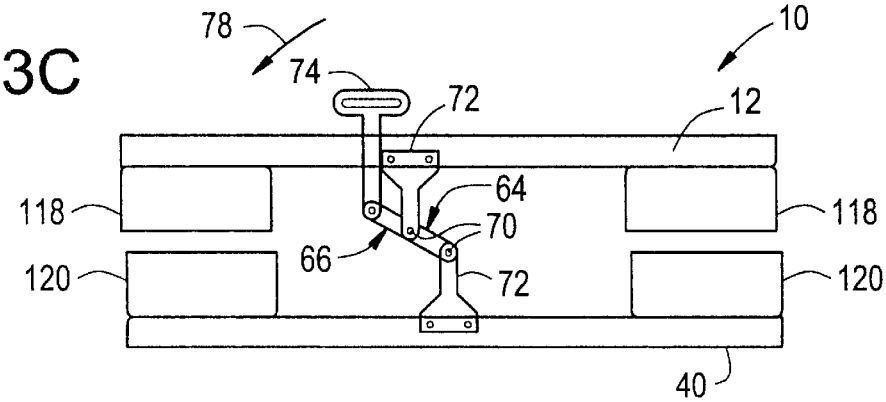
Figure 13D:
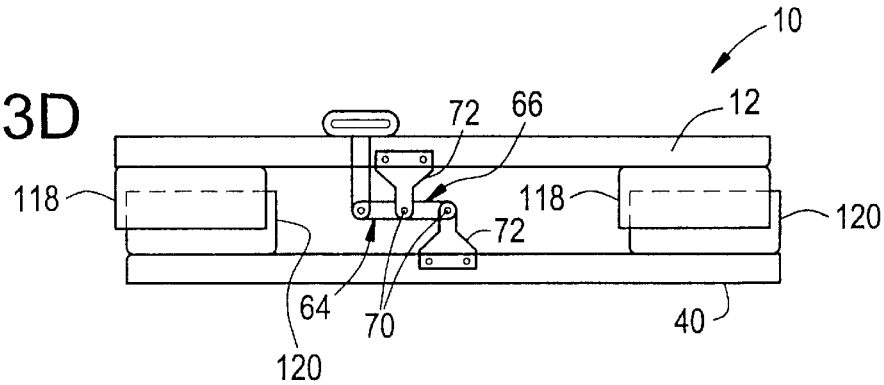
FIGS. 13D and 13E are views of a collapsible pallet in the collapsed position.
Figure 13E:
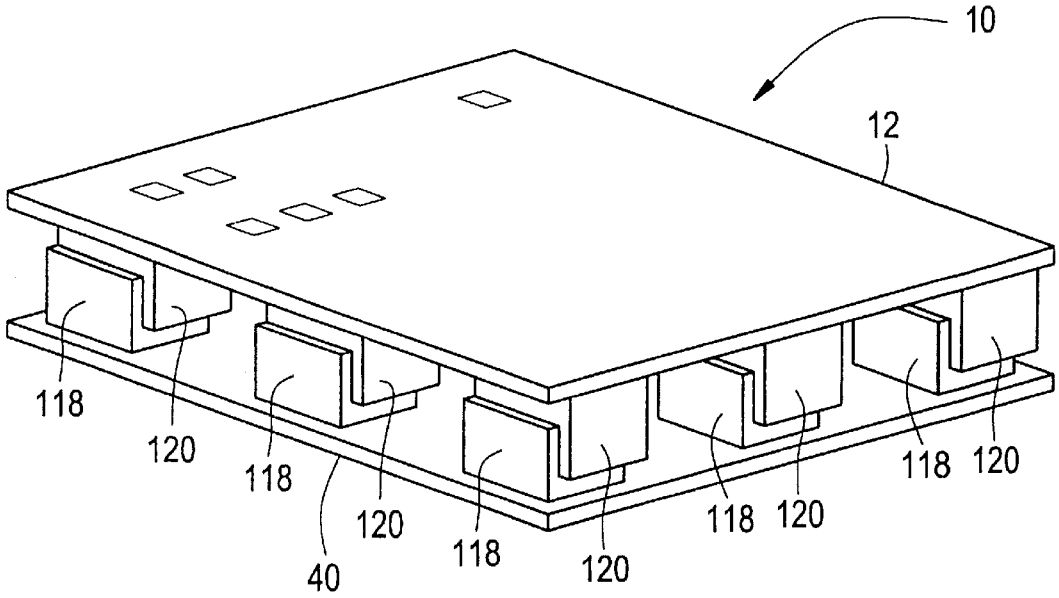

In either configuration, in the uncollapsed state, edges 126, which define one of the open sides of each first foot half 118, are in mechanical communication with edges 128, which define one of the open sides of each second foot half 120. The configuration of slits 124 allows walls 122 of each first foot half 118 to be offset from walls 122 of each second foot half 120 such that slits 124 in walls 122 of first foot half 118 are received in slits 124 in walls 122 of a corresponding second foot half 120, thereby enabling foot halves 118, 120 to nest with each other. The angle of offset is about 5 degrees to about 85 degrees, with about 45 degrees being preferred. The distance that foot halves 118, 120 are offset from each other is typically two times the wall thickness of foot halves 118, 120, e.g., about 0.100 inches to about 0.300 inches with about 0.125 inches being preferred, which is significantly thicker than the wall thickness typically employed for non-collapsing plastic pallet feet. In the embodiment shown in FIG. 12C, slits 124 can be formed on only one of the foot halves and be dimensioned to give the same amount of clearance. When foot halves 118, 120 are nested, the pallet is in its collapsed state, as shown in FIGS 13D and 13E below, and the distance between upper deck 12 and lower frame member 40 is reduced to substantially less than the height of a pallet in an uncollapsed state. Although a height reduction of up to about 75% or so is feasible, a reduction of about 60% to about 67% is readily attainable.

In order to collapse and uncollapsed an exemplary embodiment of a pallet, shown generally at 10, a lever mechanism linking upper deck 12 and lower frame member 40 can be incorporated into the structure. The lever mechanism is shown generally at 64 in FIGS. 13A through 13D. Referring to FIG. 13A, lever mechanism 64 is shown in a position that maintains pallet 10 in an uncollapsed state. Lever mechanism 64 comprises a linkage arrangement, shown generally at 66, connected to upper deck 12 and lower frame member 40. Linkage arrangement 66 comprises a tie bar 68 connected on each end to pinned supports, which are formed by pins 70 and clevises 72 mounted on deck 12 and lower frame member 40. A handle 74 can be linkably connected to tie bar 68. When handle 74 is articulated through the first half of a sweeping motion illustrated by an arrow 76, as shown in FIG. 13B, linkage arrangement 66 pivots about clevis 72 mounted on lower frame member 40 and lifts upper deck 12 away from lower frame member 40. When handle 74 is articulated through the second half of the sweeping motion illustrated by an arrow 78, as shown in FIG. 13C, upper deck 12 is pivoted toward lower deck 14 and dropped onto lower deck 14 at some offset distance, thereby allowing foot halves 118, 120 to nest together. The nesting together of foot halves 118, 120 is shown in FIGS. 13D and 13E and results in the compressed profile of pallet 10.

Figure 14:
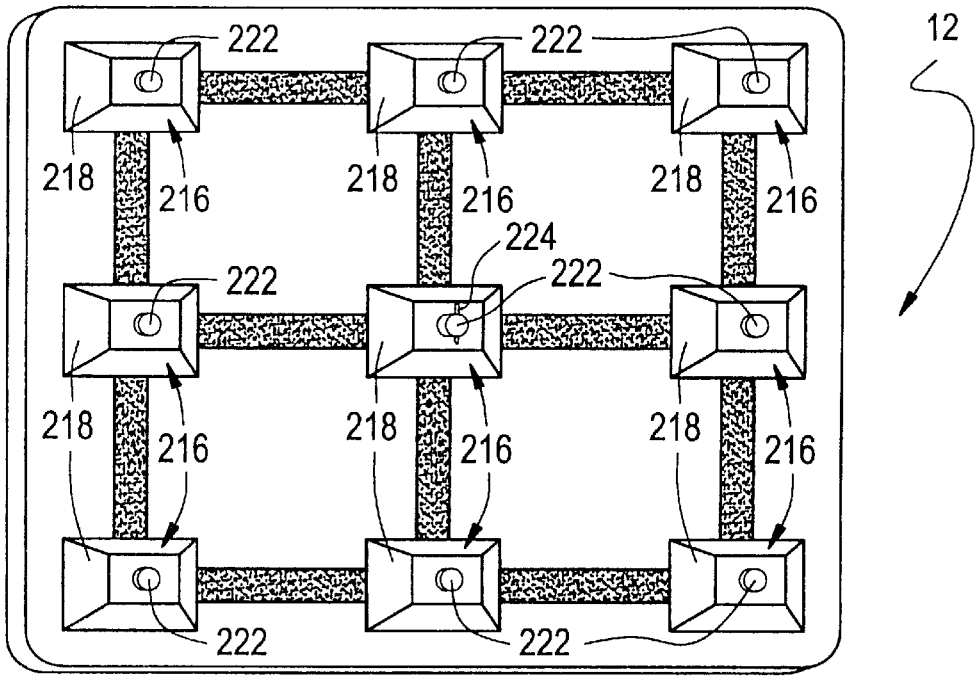
FIG. 14 is a perspective view of an underside of an upper deck of an alternate embodiment of the collapsible pallet.
Figure 15:
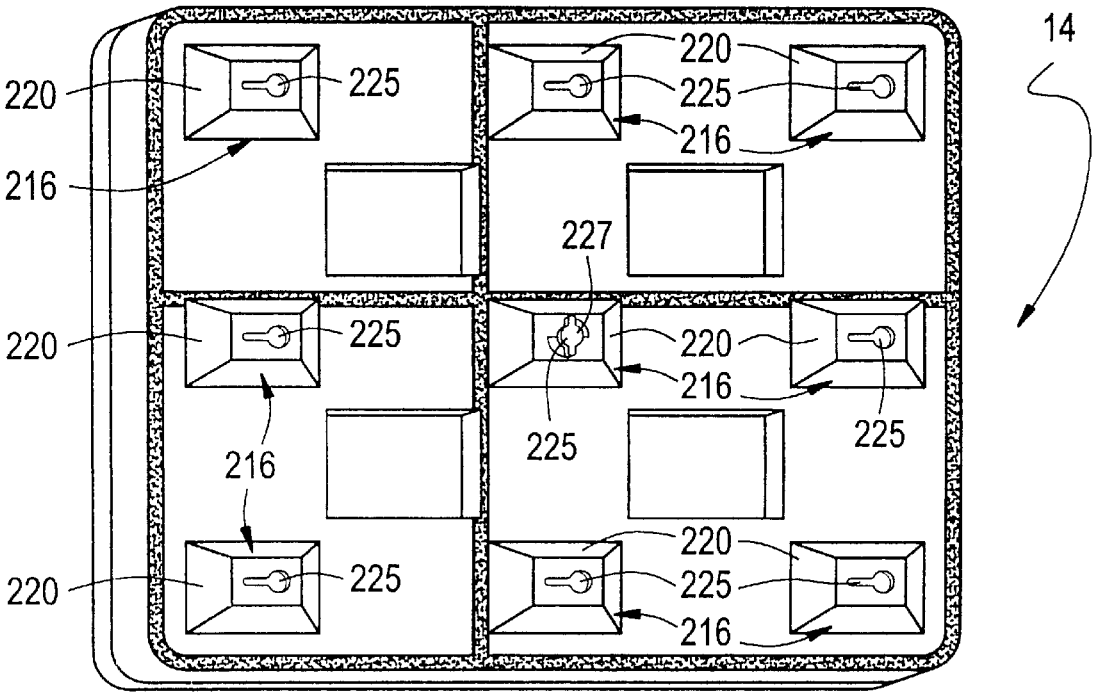
FIG. 15 is a perspective view of a topside of a lower deck of the alternate embodiment of the collapsible pallet of FIG. 14.
Figure 16:
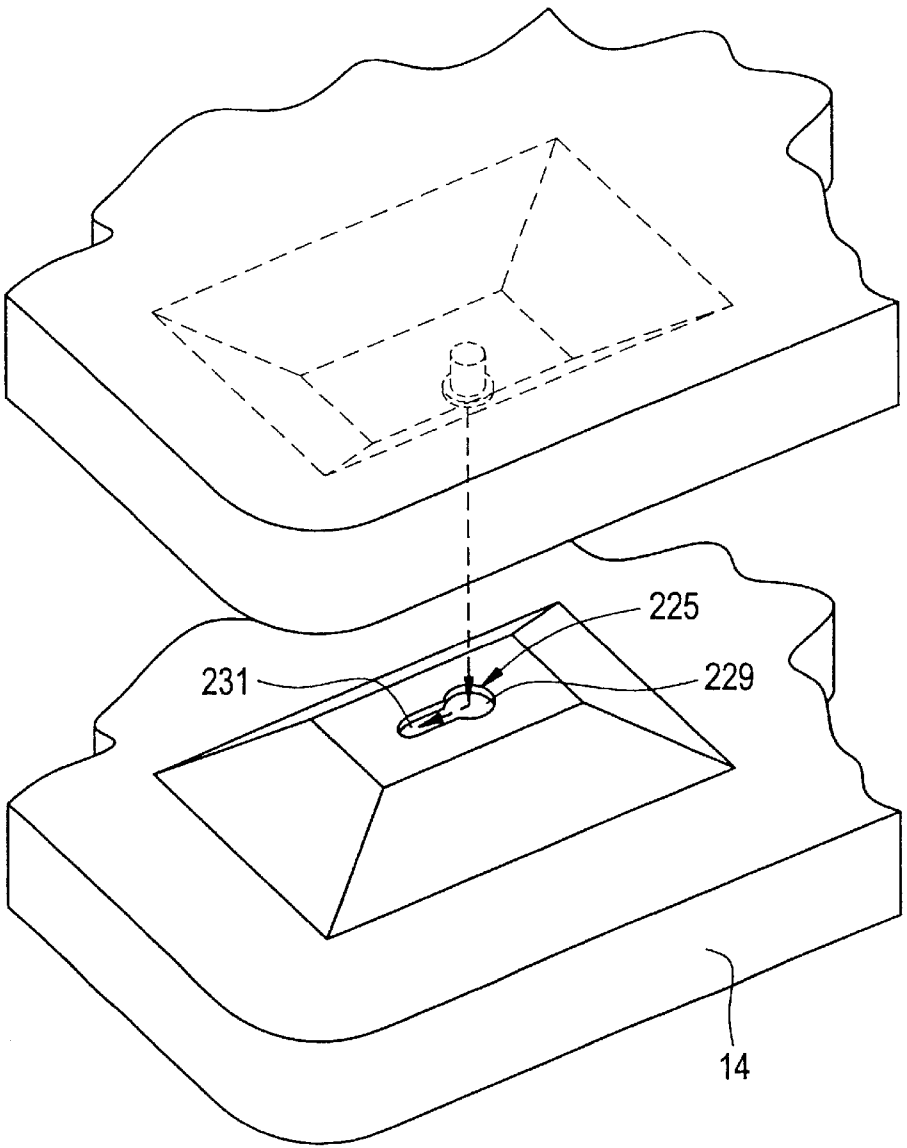
FIG. 16 is a perspective view of a lower foot half of the alternate embodiment of a collapsible pallet of FIGS. 14 and 15.

Referring to FIGS. 14 through 16, and exemplary embodiment of the pallet is shown in which an alternate collapsibility feature is employed. Upper deck 12 and a lower deck 14 are configured to have foot members 226 positioned therebetween. Foot members 216 each comprise a first foot half 218 and a second foot half 220, wherein first foot half 218 is fixedly or removably connected (mechanically or integrally bonded) to the lower surface of upper deck 12 (as is shown in FIG. 14) and wherein second foot half 220 is fixedly or removably connected (mechanically or integrally bonded) to the upper surface of lower deck 14 (as shown in FIG. 15). Foot halves 218, 220 are removably engageable with each other to maintain pallet 10 in either a collapsed or an uncollapsed state.

Referring specifically to FIG. 14, the eight first foot halves 218 are position on the perimeter of upper deck 12 and have a pin 222 protruding normally therefrom to allow upper deck 12 to be matingly received by the lower deck. The center first foot half 218 likewise includes pin 222 protruding normally therefrom, and further includes a retaining member 224 fixedly positioned laterally through pin 222 to lock with the corresponding center second foot half, as is described below. Each foot half may be tubular or solid. If each foot half is tubular, it may be filled with a support material, such as those described above, to enhance the overall structure integrity of foot members 216.

In FIG. 15, second foot halves 220 of foot members 216 are shown integrally formed with or affixed to the upper surface of lower deck 14, and are arranged so as to correspond with the positioning of the first foot halves. Each of the eight second foot halves 220 positioned on the perimeter of lower deck 14 has a hole 225 disposed therein. Holes 225 are dimensioned and positioned on the outward facing surfaces to receive the pins from the first foot halves, thereby preventing the upper deck from sliding laterally on lower deck 14. The center second foot half 220 also contains hole 225 disposed therein, which contains a cut out portion 227 that corresponds to the shape of the retaining member positioned laterally through the pin of the center first foot half. Cut out portion 227 is oriented on the outward facing surface of center second foot half 220 such that when the pin and the retaining member of the first foot half are inserted into hole 225 and cut out portion 227, and when the upper deck is rotated 90 degrees relative to lower deck 14, the upper deck is locked into place on lower deck 14 and the pallet is ready to be loaded.

Referring to FIG. 16, holes 225 are shown in greater detail. Holes 225 comprise a wider opening 229 and a narrow opening 231 to define a keyhole shape. Narrow opening 231 may be dimensioned to frictionally retain the pin from the first foot half therein, once the upper deck is rotated 90 degrees relative to lower deck 14 and slid in the direction of narrow opening 231. Foot halves 218, 220, as shown in FIGS. 14 through 16, are angularly dimensioned so as to each define frusto-pyramidical shapes. Alternately, the individual foot halves 218, 220 may be cylindrical, box-shaped, or any other geometry which provides the desired structural integrity and deck spacing. The pallet is collapsed by disengaging pins 222 from holes 225 and sliding upper deck 12 laterally such that first foot halves 218 rest on the first surface of lower deck 14 alongside second foot halves 220.

Referring now to FIGS. 17 through 26D, various embodiments of reinforcement members, for example, structural support beams, for use in the pallet are described. Reinforcement members may be incorporated into one, and preferably both, decks to maintain support in the upper deck when the pallet is lifted from below the upper deck such as experienced with typical fork lift/pallet jack equipment, thereby inhibiting the tendency for the upper deck to locally deflect or sag under loaded conditions. Likewise, reinforcement is maintained in the lower deck to provide support when the pallet experiences limited support from below such as that generated by typical chain conveyor systems commonly used in the material handling industry, thereby inhibiting the tendency for the lower deck to locally deflect or sag between the points at which it is supported.

Figure 17:
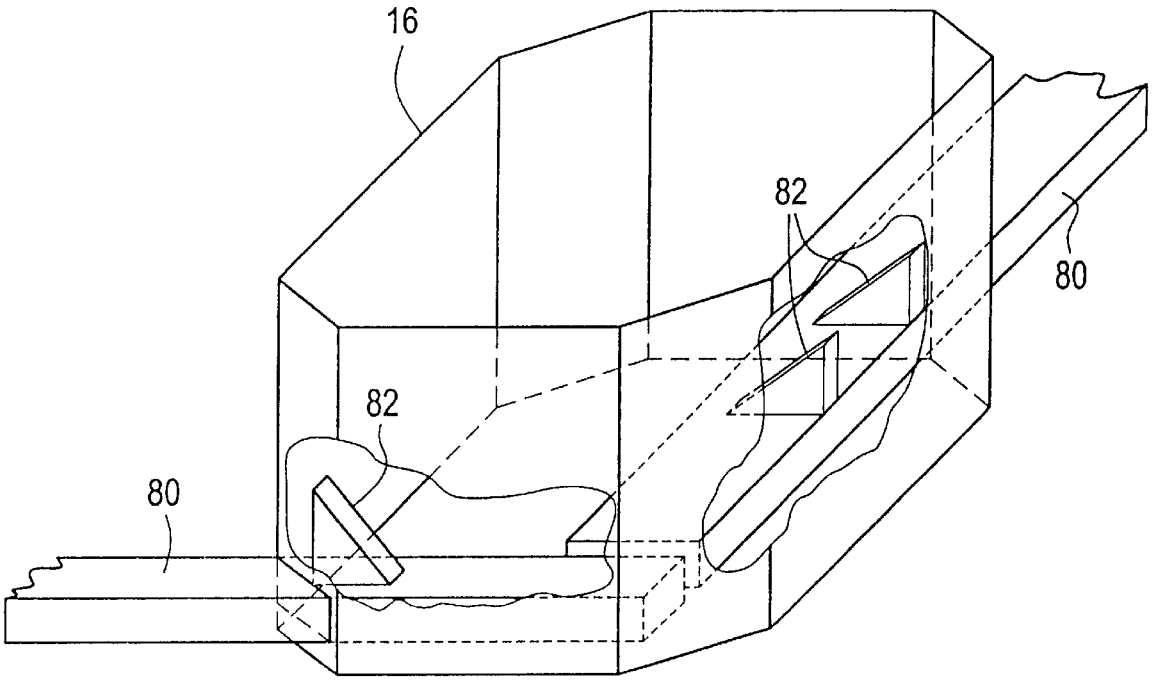
FIG. 17 is a perspective sectional view of a foot member having reinforcement members extending therein.

Reinforcement members, two of which are shown at 80 in FIG. 17, are shown as they would be mounted into foot member 16. Support to the pallet substructure is provided by the extension of reinforcement members 80 between adjacently positioned foot members 16. Such support may render the pallet and its associated substructure rigid, wherein "rigid," as it is applied to a pallet, is defined by the Virginia Tech Protocol as a deflection under load of less than 0.80 inches. (The Virginia Tech Protocol is an accepted industry standard for the validation of structural pallet performance put forth by the Virginia Polytechnic Institute). Results of tests run under the Virginia Tech Protocol have illustrated that overall deflection of the decks of the pallet can be significantly reduced through rigid support of reinforcement members 80 within foot members 16. Reinforcement members 80 may furthermore be restrained in the direction of bending at either or both the upper frame member or the lower frame member to provide additional support to the substructure. Support material (not shown), such as foam, may also be disposed within foot members 16 to provide additional support for the walls thereof and may further provide a structural base further supporting the reinforcement members 80.

Gussets 82 or similarly configured supports may be utilized to restrict out-of-plane motion, e.g., motion in directions normal to the plane of the decks of the pallet. As is shown, gussets 82 comprise triangular or similarly shaped members, at least one edge of which is fixedly disposed at an inner wall of foot member 16 and another edge of which is in direct engagement with a surface of reinforcement member 80. Gussets 82 are generally molded, extruded, welded or otherwise affixed to the interior surfaces of the walls of foot member 16 to prevent movement of reinforcement members 80 in vertical directions when the upper deck is oriented for normal use. The filling of foot member 16 with the support material (e.g., rigid foam and the like) generally contributes to the support of gussets 82, thereby further contributing to the support imparted to the adjacent structure. Additionally, foam filling of foot members 16 allows gussets 82 to be thinner in width while still increasing buckling resistance and reducing overall pallet weight.

Figure 18:
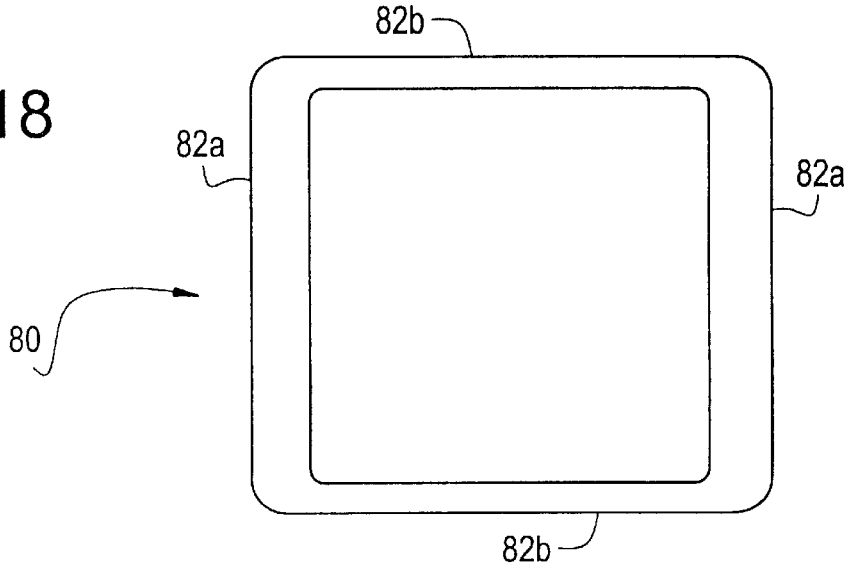
FIG. 18 is a front sectional view of a reinforcement member having a rectangular cross section.

Referring now to FIG. 18, reinforcement member 80 is illustrated as having variable wall thickness and is configured and dimensioned to be incorporated into the structure of the frames of the pallet, thereby enhancing the structural integrity of the pallet. Variations in wall thickness, e.g., variations in which sidewalls (also know as support members) 82*a* of reinforcement member 80 are thicker than adjacent sidewalls 82*b,* allows for the optimization of rigidity of reinforcement member 80 by maximizing the amount of material of construction at areas in which the greatest contributions to bending strength occur. The thickness of my one of the walls of reinforcement member 80 may be varied, thereby further contributing to the optimization of rigidity of reinforcement member 80 while minimizing weight. Furthermore, although reinforcement member 80 is illustrated as being of a substantially rectangular cross section, it should be realized, by those of skill in the art, that reinforcement member 80 may be of a cross-section of any shape including, but not being limited to, triangular, elliptical, oval, H-shaped, or the like. Additionally, reinforcement member 80 may be configured as are I-beam, a Z-beam, or the like, or it may include arrangements of cross members disposed therein for added support.

Enhancement of the structural integrity of any configuration of reinforcement member 80 (as shown by the incorporation of the gussets in FIG. 17), may be incorporated into the design of the pallet depending upon the positioning of reinforcement member 80 in the deck, the particular configuration of the deck itself, or the load bearing requirements of the pallet. Optimization of the geometry of reinforcement member 80 may result in an overall pallet weight while providing necessary support against deflection. Materials from which reinforcement member 80 can be fabricated include, but are not limited to, ferrous materials (e.g., steel, stainless steels (such as the 900 series and the 1000 series), and the like), aluminum, titanium, chromium, molybdenum, carbon, composities and alloys of the foregoing materials, and combinations comprising at least one of the foregoing materials. A corrosion inhibiting compound may be disposed over the material of fabrication. In any event, the material from which reinforcement member is fabricated should be of a yield strength of greater than about 40,000 psi, and preferably greater than about 50,000 psi.

Figure 19A:
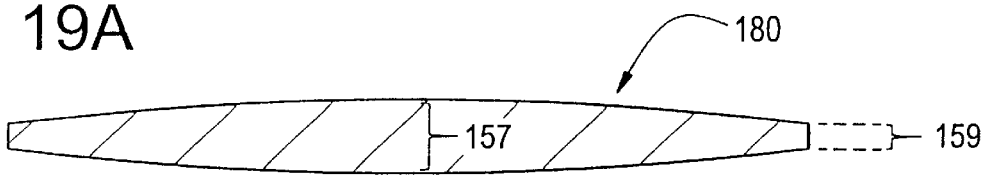
FIGS. 19A and 19B are side elevation sectional views of various embodiments of reinforcement members.
Figure 19B:
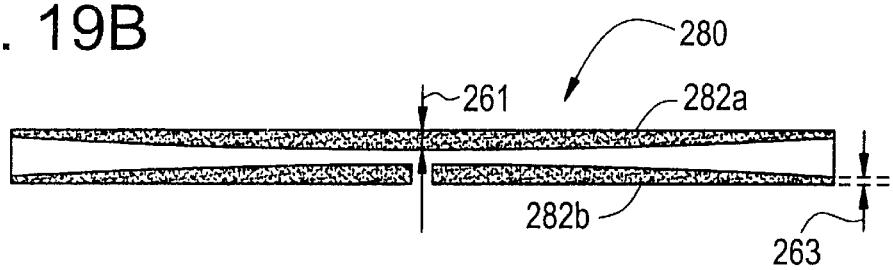

The overall strength of the reinforcement member may further be enhanced by providing variations in the dimensions of the individual walls thereof, as is illustrated with respect to FIGS. 19A and 19B. As is shown in FIG. 19A, reinforcement member 180 may be configured to have a uniform or varied wall thickness and optionally a variable width. In order to contribute the maximum strength to the pallet into which reinforcement member 180 is incorporated, the width of reinforcement member 180 is preferably such that a maximum width occurs at the center 157 thereof and a minimum width occurs at the ends 159. A reinforcement member 280 may also be configured to have a uniform width but varied wall thickness over its length, as is shown in FIG. 19B. In reinforcement member 280, the thickness of opposing sidewalls 282*a,* 282*b* are generally greatest at a point 261 substantially in the center and least at points 263 at the ends.

Figure 20:
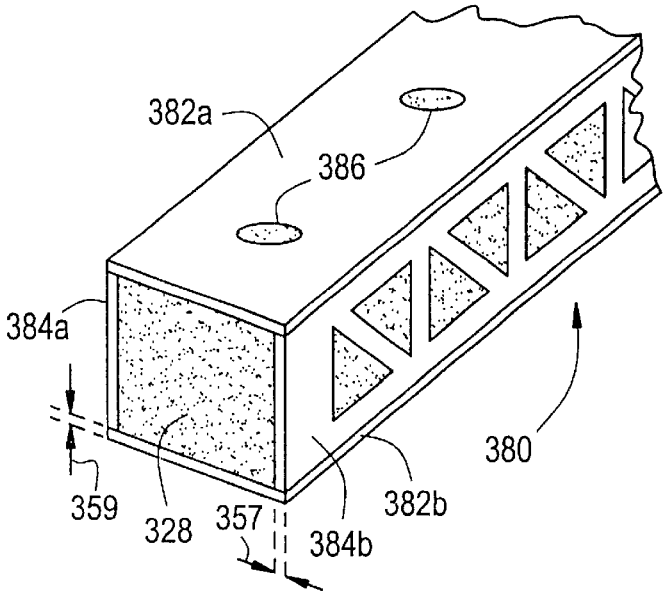
FIGS. 20 through 22 are perspective and sectional views of various embodiments of reinforcement members.

Referring now to FIG. 20, another exemplary embodiment of a reinfocement member capable of being incorporated into either or both of the deck structures and the foot assemblies is shown generally at 380. Reinforcement member 380 comprises opposing plates 382*a,* 382*b* arranged in a spaced planar relationship joined by a support element comprising side supports (also referred to as support members) 384*a,* 384*b* to define a structure. The structure may be filled with a support material 323 that becomes rigid upon curing. Opposing plates 382*a,* 382*b* may be perforated with openings 386 to reduce the overall weight of reinforcement member 380. Side supports 384*a,* 384*b* join opposing plates 382*a,* 382*b* at the longer edges thereof and may also be perforated to reduce the overall weight of reinforcement member 380. In addition, or as an alternative to perforation (s) side supports 384*a,* 384*b* can have a thickness 357 that is less than a thickness 359 of plates 382*a,* 382*b*. Preferably, the support thickness 357 is sufficient to impart sufficient structural integrity to reinforcement member 380 to maintain a distance between plates 382*a,* 382*b* substantially equivalent to the distance maintained between side supports 384*a,* 384*b*. In one embodiment, side supports 384*a,* 384*b* are perforated with triangular openings defined therein arranged in alternating orientations to form a truss-like pattern. In other embodiments, side supports 384*a,* 384*b,* as well as plates 382*a,* 382*b,* may be perforated with circular, substantially circular, multi-sided, oblong openings, or the like as well as any combination comprising at least one of these geometries. In either configuration, support material 328 can be retained between side supports 384*a,* 384*b* and opposing plates 382*a,* 382*b* by the overall structure of reinforcement member 380 and its perforations.

Figure 21:
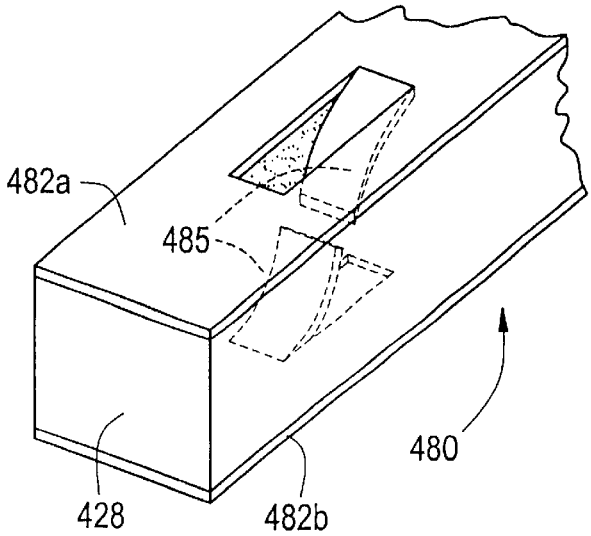
Figure 22:
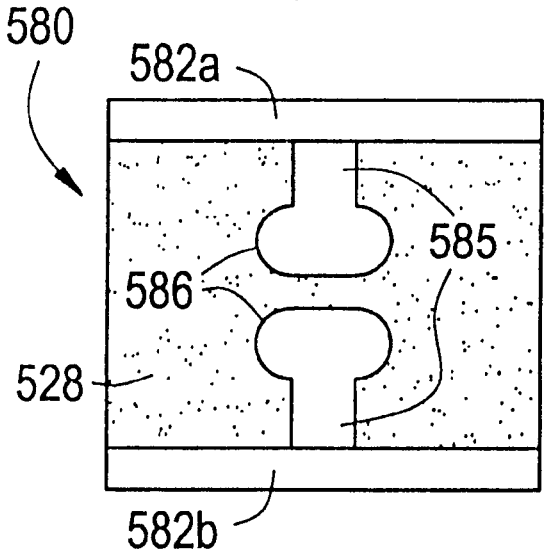

In another exemplary embodiment, shown in FIG. 21, a reinforcement member 480 may be configured without side supports to form a layered beam where opposing plates 482*a,* 482*b* are connected to a support material 428 with an adhesive or mechanical connection. Support material 428 is typically a rigid foam layer that may provide its own adhesion to opposing plates. Inner feature surfaces of opposing plates 428*a,* 428*b* may contain tabs (protrusions, and the like) 485 that may be bent or otherwise protrude into the support material 428 to provide fastening for opposing plates 482*a,* 428*b* to support material 428. In another embodiment of a reinforcement member, shown generally at 580 in FIG. 22, opposing plates 582*a,* 582*b,* may have appendages 585 integrally formed into or fixed directly on opposing plates 582*a,* 582*b*. Appendages 585 preferably have knobbed ends 586 to enable a support material 528 (such as a foam layer) formed around appendages 585 to grasp appendages 585 and maintain support material 528 in contact with opposing plates 582*a,* 582*b*.

Figure 23:
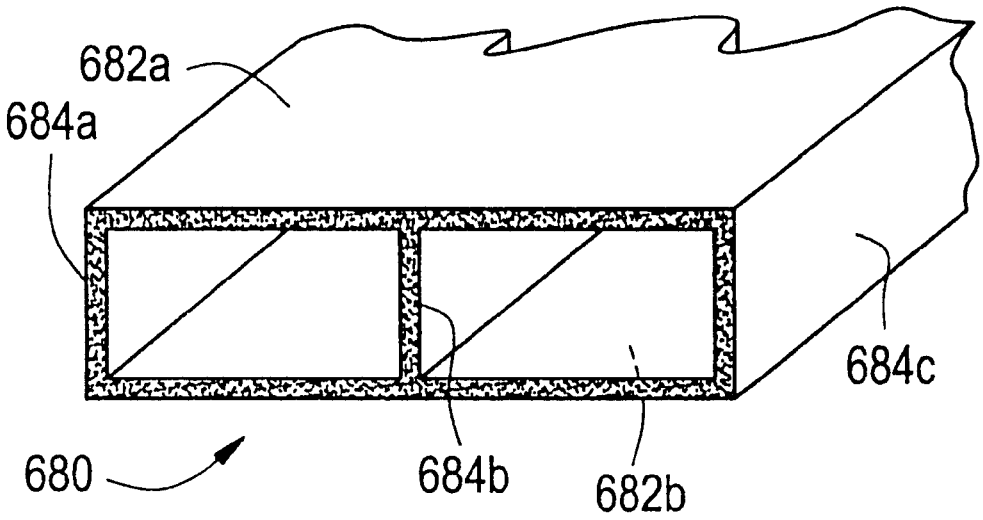
FIG. 23 is a perspective view of a reinforcement member having three supporting walls disposed between opposing plates.

Referring to FIG. 23, yet another exemplary embodiment of a reinforcement member is shown generally at 680. Reinforcement member 680 comprises two opposing plates 682*a,* 682*b* separated by at least three walls 684*a,* 684*b,* 684*c* arranged to be parallel to each other and perpendicular to plates 682*a,* 682*b*. The configuration of reinforcement member 680 having at least three perpendicularly arranged walls 684*a,* 684*b,* 684*c* allows for a savings in weight over a configuration in which two reinforcement members having rectangular cross-sections are longitudinally connected to each other to form a single reinforcement member. Furthermore, the configuration of reinforcement member 680 having "shared" walls enables a bending strength to be maintained that is nearly equal to the bending strength of a configuration of adjacently positioned reinforcement members having adjacently positioned vertical walls.

Figure 24A:
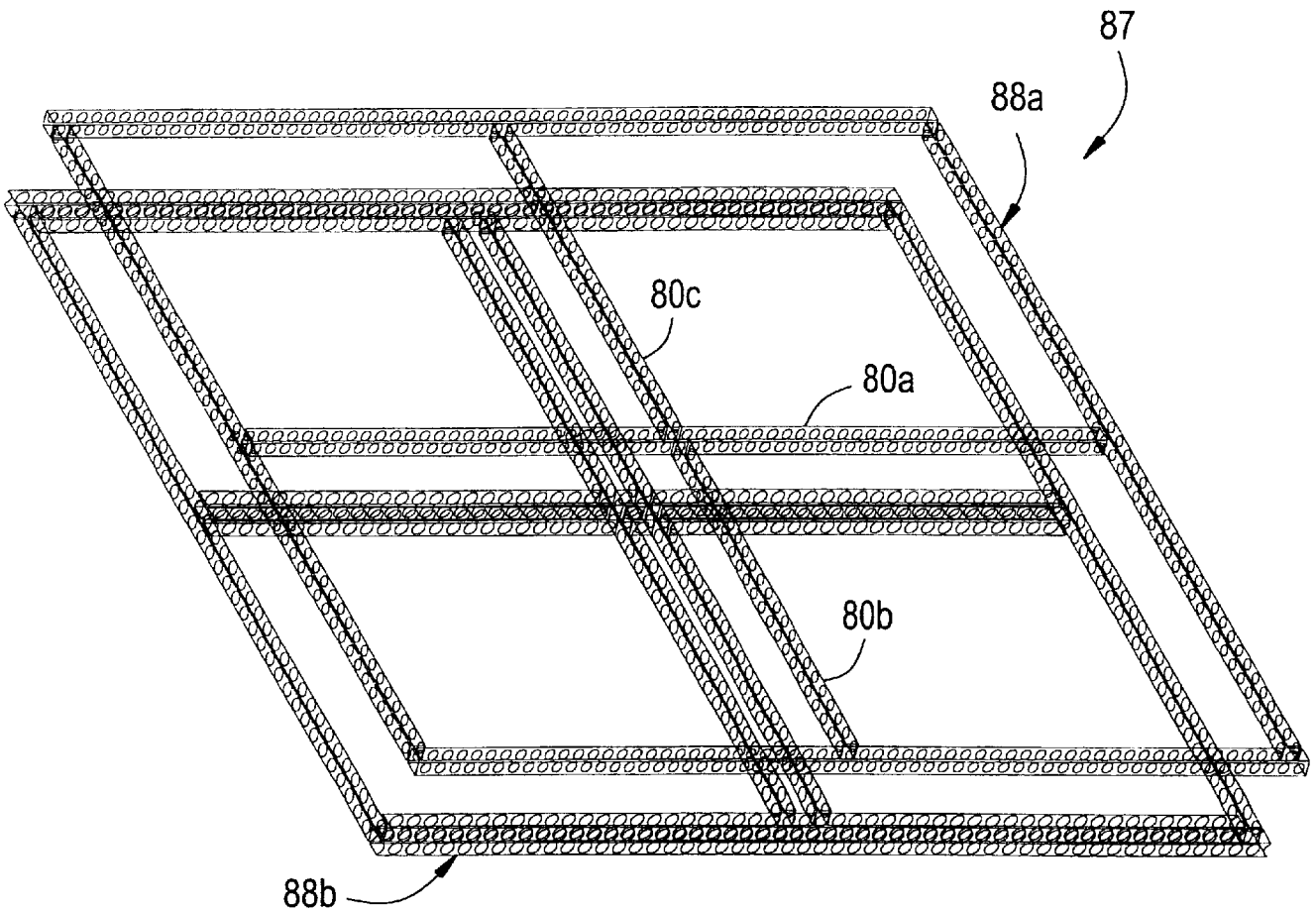
FIG. 24A is a perspective view of upper and lower reinforcement structures of a pallet.
Figure 24C:
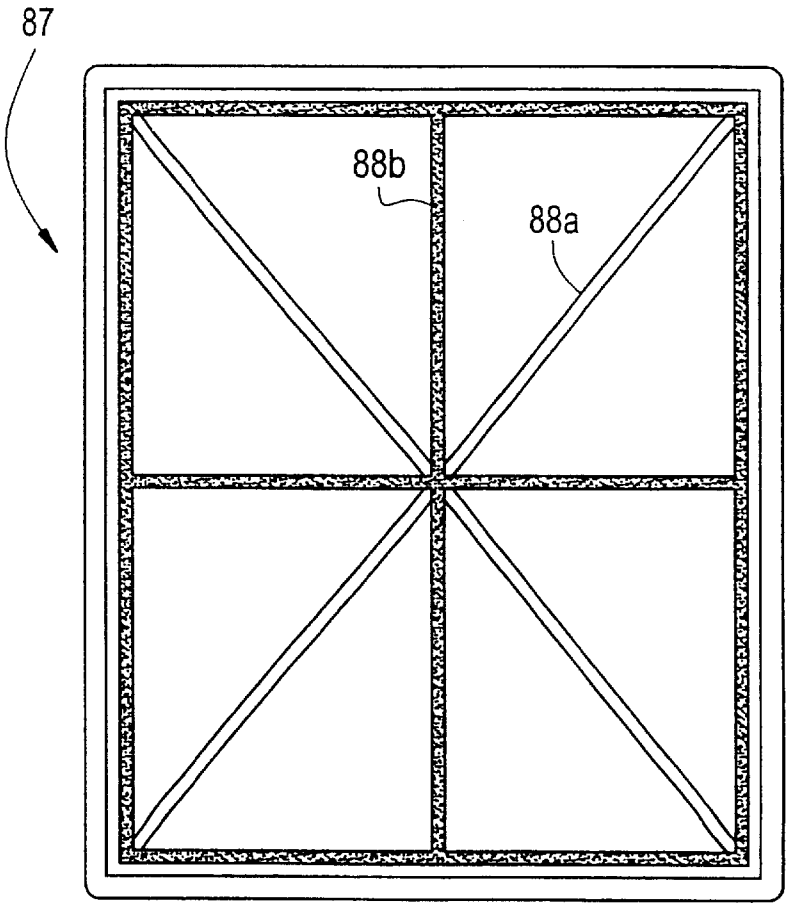
FIGS. 24B and 24C are plan views of upper and lower reinforcement structures of a pallet disposed at angles relative to each other.
Figure 24B:
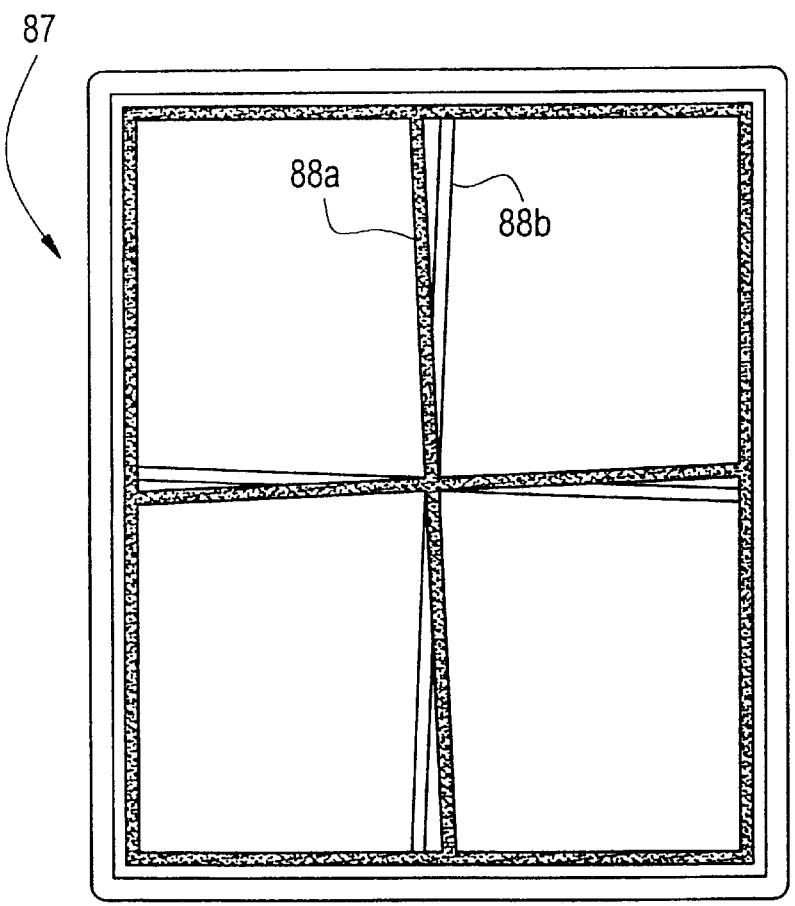

Referring now to FIGS. 24A through 24C, an exemplary arrangement of the reinforcement members within the deck structure of the pallet is shown generally at 87. The arrangement of the reinforcement members comprises an upper reinforcement structure, shown generally at 88*a,* disposed in the upper deck of the pallet and a lower reinforcement structure 88*b,* disposed in the lower deck of the pallet. Upper reinforcement structure 88*a* comprises a first reinforcement member 80*a* and second and third reinforcement members 80*b,* 80*c,* each extending from opposing sides of first reinforcement member 80*a*. Lower reinforcement structure 88*b* is substantially similar. In order to minimize the amount of deflection when such a configuration is utilized in construction of the pallet, second and third reinforcement members 80*b,* 80*c* are welded to opposing sides of first reinforcement member 80*a*. In order to further minimize the amount of pallet deflection in an assembled pallet, upper and lower reinforcement structures 88*a,* 88*b* are preferably disposed in orientations that are angled relative to each other, thereby resulting in at least one continuous beam across the pallet mid-section in both directions when viewing the assembly from a macro perspective. In a finished pallet of the above configuration, deflection limitations of the deck structures, in relation to the finished pallet, generally comply with construction and operation guidelines established under the Virginia Tech Protocol.

Other configurations of arrangement 87 are shown generally in FIGS. 24B and 24C in which reinforcement structures 88*a,* 88*b* are mounted within upper and lower frame members 36, 40. In FIG. 24B, arrangement 87 is illustrated as having upper reinforcement structure 88*a* angled a few degrees relative to lower reinforcement structure 88*b,* thereby resulting in a configuration of reinforcement structures 88*a,* 88*b* in which one structure is slightly skewed relative to the other structure. In FIG. 24C, arrangement 87 is configured such that upper reinforcement structure 88*a* is angled at 45 degrees relative to lower reinforcement structure 88*b*. Regardless of the angle, rotation of one reinforcement structure relative to the other generally results in an enhanced structural integrity of the pallet, particularly in directions normal to the planes of the decks.

Figure 24D:
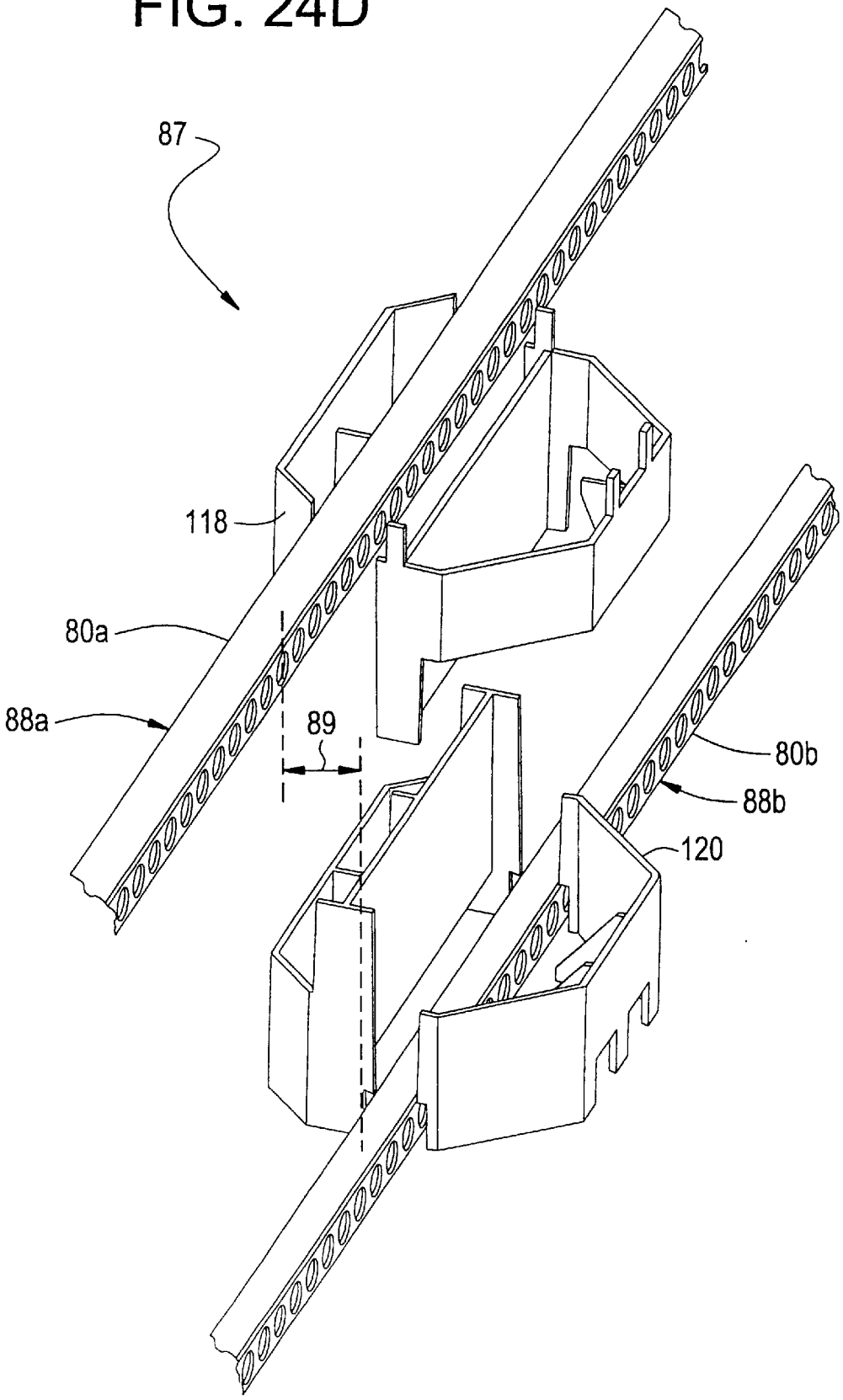
FIG. 24D is an exploded perspective view of a portion of upper and lower reinforcement structures of a pallet showing an offset dimension.

Referring to FIG. 24D, arrangement 87 may also be configured such that reinforcement members 80*a* disposed in upper reinforcement structure 88*a* are parallel to but offset from reinforcement members 80*b* disposed in lower reinforcement structure 88*b*. In such a configuration, matable upper and lower foot halves 118, 120 are configured such that the respective reinforcement members 80*a,* 80*b* extending therethrough are offset by a distance 89. Because reinforcement members 80*a,* 80*b* are not aligned in a vertical direction, improved support is maintained with respect to reinforcement structures 88*a,* 88*b* in directions normal to the directions in which reinforcement structures 88*a,* 88*b* extend.

To provide additional structural integrity to the pallet, either or both reinforcement structures 88*a,* 88*b* may be slightly bowed out of the plane of the pallet decks and in a direction opposite to the deflection of the pallet under load. The degree of bowing may be slight, for example, less than about one inch in a direction normal to the deck over the distance between opposing edges of the pallet. By incorporating such a bow into the architecture of reinforcement structures 88*a,* 88*b,* the deflection of the decks are compensated for upon loading of the pallet, thereby imparting additional strength to the pallet substructure.

Figure 25:
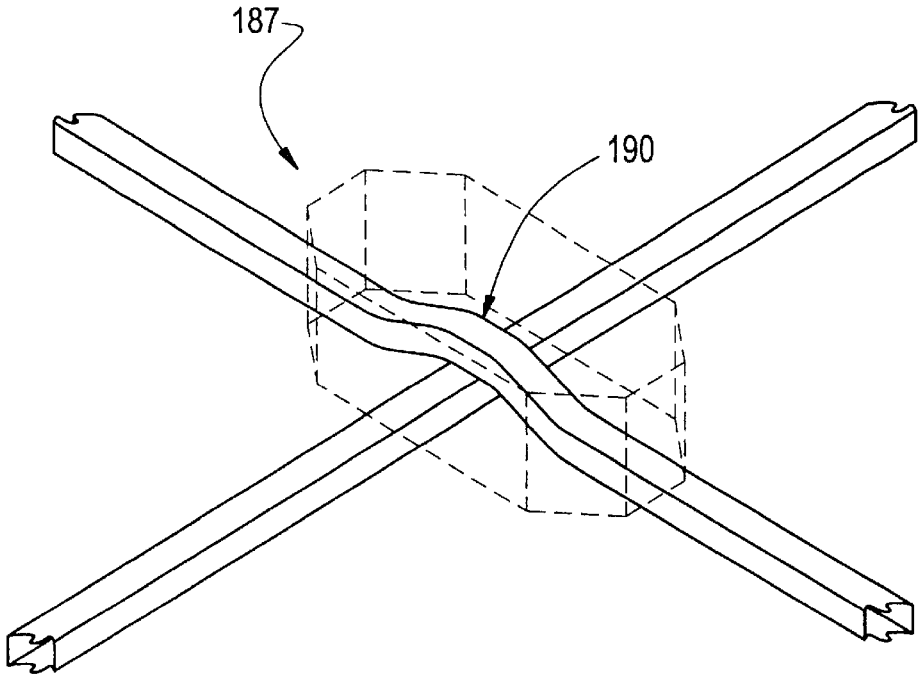
FIG. 25 is a perspective view of an arrangement of reinforcement members arranged in a cross-over pattern.

Another exemplary arrangement of the reinforcement members within the deck structure of the pallet is shown generally at 187 in FIG. 25. Arrangement 187 minimizes the amount of deflection in an assembled pallet by overlapping reinforcement members 80 to form a crossover point 190. A configuration of reinforcement members 80 to form crossover point 190 eliminates the need for the welding of a cut reinforcement member, thereby reducing the manufacturing assembly complexity. Although crossover point 190 may be positioned at any point where reinforcement members 80 intersect, a configuration in which crossover point 190 corresponds with the positioning of one of the feet of the pallet allows the additional height resulting from the crossover of reinforcement members 80 to be incorporated into the corresponding foot, thereby minimizing the impact of crossover point 190 on the functionality of the pallet, particularly with respect to the size of the fork openings. Although arrangement 187 is shown incorporating the reinforcement structures previously denoted as 80, it should be understood by those of skill in the art that any variation of the foregoing reinforcement structures can be used with arrangement 187.

Figure 26A:
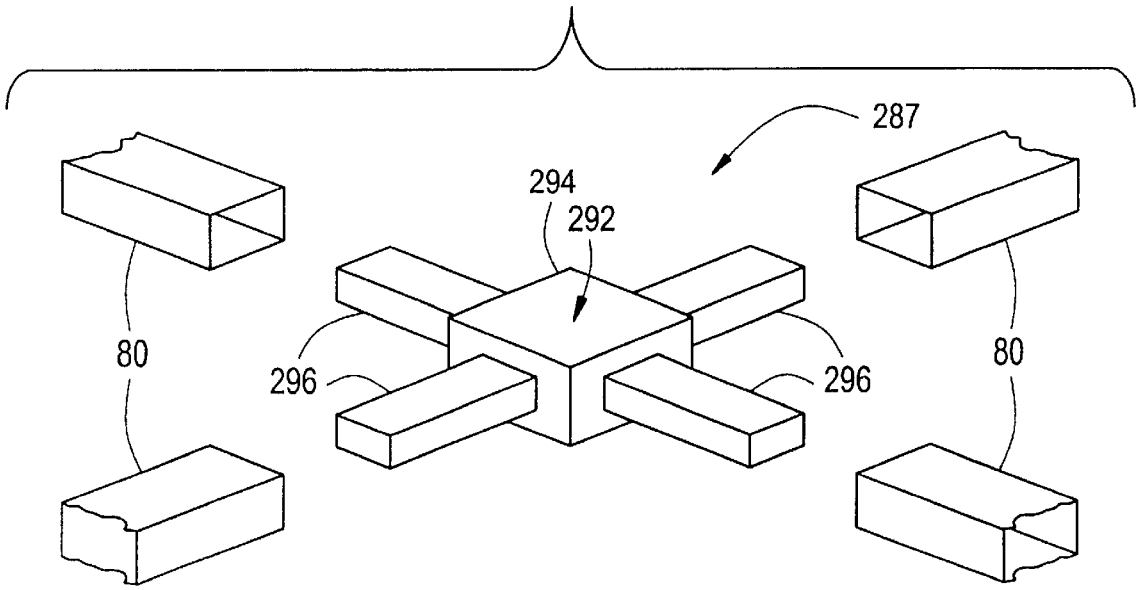
FIGS. 26A through 26D are perspective views of various arrangements illustrating the engagements of reinforcement members to form reinforcement structures.
Figure 26B:
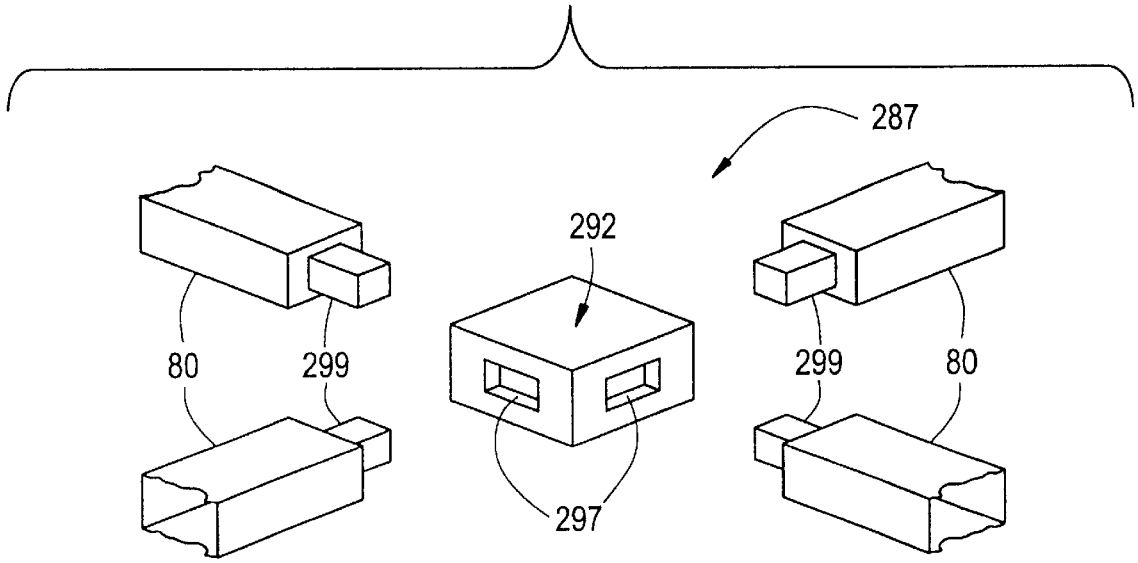
Figure 26C:
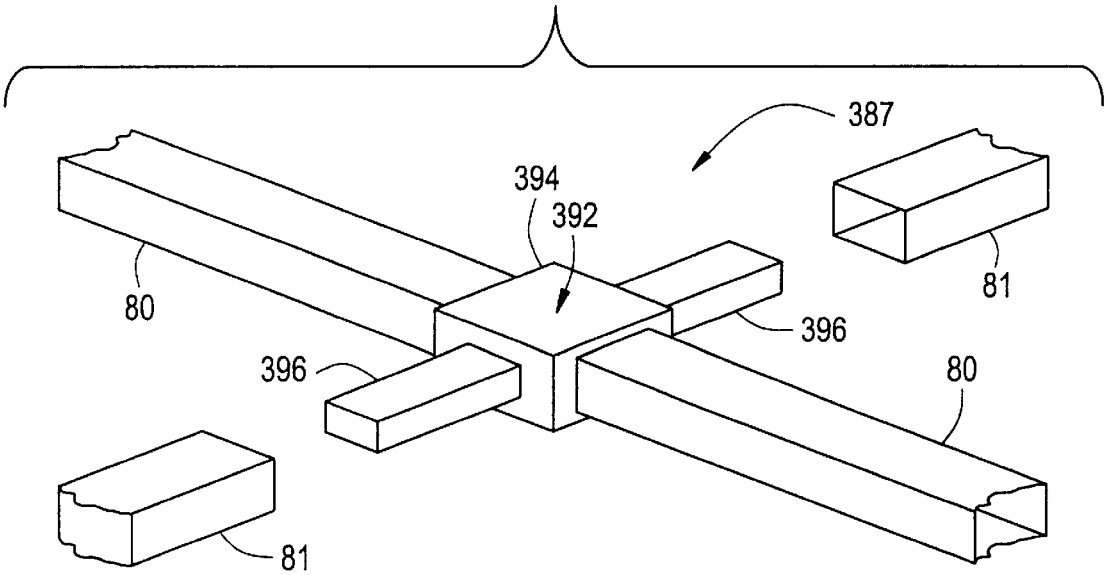
Figure 26D:
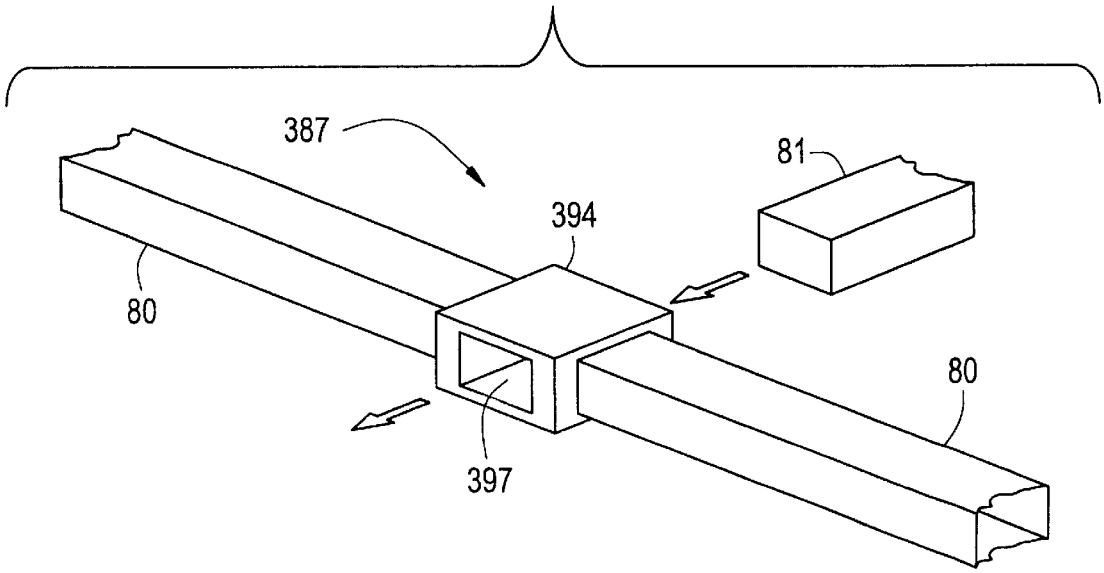

Referring now to FIGS. 26A through 26D, other exemplary arrangements of the reinforcement members within the deck structure of the pallet are shown. In FIG. 26A, an arrangement, shown generally at 287, comprises a multi-leg structural insert member, shown generally at 292, onto which reinforcement members 80 can be slidably received. Alternately, as is shown in FIG. 26B, arrangement 287 having multi-leg structural insert member 292 may be configured to slidably receive reinforcement members 80 therein. In FIG. 26A, multi-leg structural insert member 292 comprises a hub 294 having a plurality of legs 296 extending therefrom. Each leg 296 of the plurality extends such that all legs 296 are co-planar and opposingly oriented legs extend in opposing directions. In FIG. 26B, multi-leg structural insert member 292 comprises openings 297 into which tabs 299 on the ends of reinforcement members 80 can be inserted. In FIG. 26C, an arrangement 387 having a multi-leg structural member 392 is illustrated in which a hub 394 is integral with reinforcement member 80. Hub 394 comprises a plurality of legs 396 (two of which are shown) upon which reinforcement members 81 may be slidably received. Those of skill in the art will appreciate that, as above, legs 396 may be configured to receive the reinforcement members therein. In FIG. 26D, arrangement 387 having hub 394 integrally formed with a reinforcement member 80 is shown having an opening 397 therein that enables reinforcement member 81 to be received directly therethrough. Such embodiments as illustrated in FIGS. 26A through 26D allow the construction of the reinforcement structures incorporated into the decks of the pallet to simplify the assembly process, thereby eliminating costs associated with welding.

Referring back to FIGS. 24A through 24C, it should be appreciated that the number of individual reinforcement members 80 in reinforcement structure 88*a* disposed in the upper deck of a pallet may vary from the number of individual reinforcement members in reinforcement structure disposed in the lower frame member of the pallet. The requirements of the Virginia Tech Protocol result in greater stresses in the lower deck of a pallet than the upper deck of the same pallet. It may be, therefore, advantageous to provide lower reinforcement structure 88*b* as having configurations of two or more reinforcement members connected and disposed adjacent to each other in lower reinforcement structure 88*b* to allow for a more even distribution of the load applied to the pallet. Alternatively, lower reinforcement structure 88*b* could incorporate the same single beam arrangement as described in upper reinforcement structure 88*a;* however, the beam geometry could be developed such that the lower reinforcement beams have greater bending strength. This could be accomplished through the use of material with improved mechanical properties (e.g., a material having superior modulus and yield strength) or through improved geometry resulting in greater section moduli relative to upper reinforcement beams.

Referring to all of the FIGURES, the componentry of the pallet is fabricated from various techniques that include, but are not limited to, injection molding (low and high pressure), blow molding, casting, thermo-forming, twin sheet thermo-forming, stamping, and similar methods. Materials from which any embodiment of the pallet, e.g., namely the decks and feet, may be fabricated include plastics (thermoplastics, thermosets, and combinations comprising at least one of the foregoing materials). Components of the pallet may also be fabricated from metals or wood. Some plastics that may be used include, but are not limited to, polyethylene, polypropylene, polyetherimide, nylon, polycarbonates, polyphenylether, polyvinylchloride, engineering polymers, and the like, as well as combinations comprising at least one of the foregoing plastics.

The material from which upper deck 12 is fabricated may further include a woven polymer, preferably a biaxially woven polymer, comprising polypropylene, polyethylene, or a combination comprising at least one of the foregoing materials. The resulting biaxial weave may be bonded to a substrate to form a layered composite deck structure, or it may be incorporated into the plastic from which deck halves 18, 20 are fabricated by being attached to the plastic at the point of its extrusion, e.g., from a thermo-forming apparatus (not shown). Strands of filler may also be woven into the biaxial structure and/or included in the plastic itself to provide a myriad of different properties to the pallet. Some possible fillers include, but are not limited to, ultraviolet (UV) stabilizers, heat stabilizers, flame retardants, structural enhancements (i.e., glass fibers, carbon fibers, and the like), biocides, and the like, as well as combinations comprising at least one of the foregoing fillers.

Referring back to FIGS. 3 through 6, upon assembly of upper deck 12, the space defined between halves 18, 20 (or the spaces defined by ribs 113 and cross beams 115 in the skeletal substructure of upper deck 112) may be filled with support material 28. Support material 28 provides structural integrity to upper deck 12, thereby providing increased stability for a load supported thereon. Other factors that are taken into account in choosing foam materials are their ability to resist compressive forces and their hydrophobicity (i.e., their ability to resist water absorption). Possible materials that can be employed as support material 28 as well as for other support materials discussed herein (e.g., 328, 428, among others) include, but are not limited to, plastics (thermoplastics, thermosets, and the like), foams (e.g., rigid and/or semi-rigid), wood, fiberglass, porous ceramic, porous metal, and combinations comprising at least one of the foregoing materials, with foams being preferred. Various types of polymer foams and plastics that can be incorporated into the design of upper deck 12 include, but are not limited to, polyurethanes, polystyrenes, and polyethylenes, as well as combinations comprising at least one of the foregoing materials. Foams, primarily urethane-based foams, are generally preferred for use in the applications at hand due to their expansive nature (manufacturability enhancement), strength-to-weight ratio, and their ability to absorb impact forces when used in a composite structure, which most frequently result from the dropping of objects on the pallet or the dropping of the pallet onto a hard surface. Alternately, the support material may also be a structural foam/plastic material comprising expandable polyurethanes or expandable polystyrenes. Such foam/plastic materials are made expandable via steam injection or a reaction injection molding (RIM) process, for example. In the RIM process, the foam/plastic materials are injected between boundary surfaces, for example, between the defining deck halves of the upper deck of a pallet, where they react and expand in volume to fill the space between the boundary surfaces. A catalyst may be employed to initiate the chemical reaction. Because urethane-based foam materials are sufficiently rigid even when punctured or otherwise broken, when incorporated into the structure of the pallet, it retains its ability to weather impacts and compressive forces that would cause permanent damage to wooden pallets.

The polymer foams are generally employed at densities of up to and even exceeding about 50 pounds per cubic foot ($lb/ft^3$). In order to enhance structural integrity while minimizing weight penalties, the density is preferably less than or equal to about 10 $lb/ft^3$, with less than or equal to about 8 $lb/ft^3$ preferred, and less than or equal to about 4 $lb/ft^3$ especially preferred. Also preferred is a density of greater than or equal to about 1 $lb/ft^3$, with a density of greater than about 2 $lb/ft^3$ more preferred.

The use of plastic in the fabrication of the pallet allows the pallet to meet or exceed the load bearing and durability requirements while keeping the weight of the pallet at a minimum. The weight of pallet 10 (having an upper deck size of 40 inches by 48 inches) is below about 5.2 pounds per square foot ($lb/ft^2$) based upon the upper deck dimensions, with less than or equal to about 4.9 $lb/ft^2$ more preferred, less than or equal to about 4.5 $lb/ft^2$ even more preferred, and about 2.5 $lb/ft^2$ to about 4.5 $lb/ft^2$ especially preferred while meeting the specifications of the Virginia Tech Protocol. Pallets developed for market specific applications which do not fall under the guidelines of the GMA or the Virginia Polytechnic Institute may have weights less than 2.5 $lb/ft^2$ or greater than 5.2 $lb/ft^2$ as dictated by the particular application.

Figure 27:
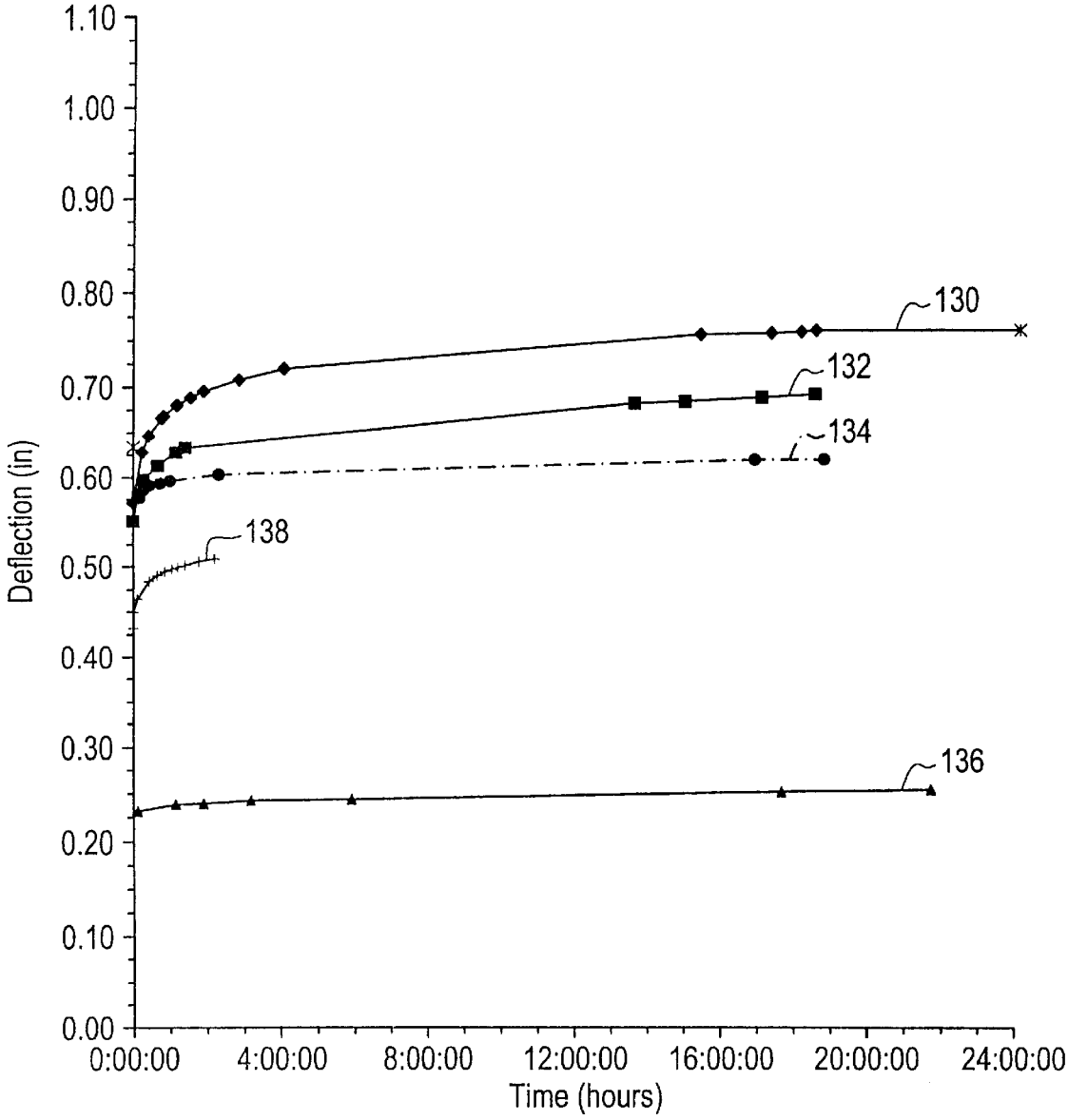
FIG. 27 is a graph showing the amount of pallet deflection.

The Virginia Tech Protocol has become the qualifying document for successful pallet design. Numerous prior art plastic pallets were tested, and the results plotted as lines 130 and 132 on the graph of FIG. 27. Conventional wooden pallets were also tested and plotted as lines 134, and 136 representing block (4-way entry) and stringer (2-way entry) pallets respectively. The plastic pallet referred to in the foregoing FIGURES was tested and plotted as line 138. All testing was performed under identical conditions and involved loading the pallets with 2,800 pounds of sand at room temperature for periods ranging from 2 to 24 hours with 30 day results extrapolated from the curves. One of the specifications of the Virginia Tech Protocol requires that the pallets deflect less than 0.80 inches over a period of 30 days at 115 degrees Fahrenheit to meet their acceptance criteria. As can be seen from the graph, the plot of line 138 for the plastic pallet showed the smallest amount of deflection over about a two-hour period of time. Furthermore, although all pallets tested were under the 0.80 inch deflection limit, albeit at room temperature, only the plastic pallet met the weight requirement imposed on pallets by weighing under the 50 pound weight limit (i.e., about 3.7 $lb/ft^2$ or less).

Figure 28:
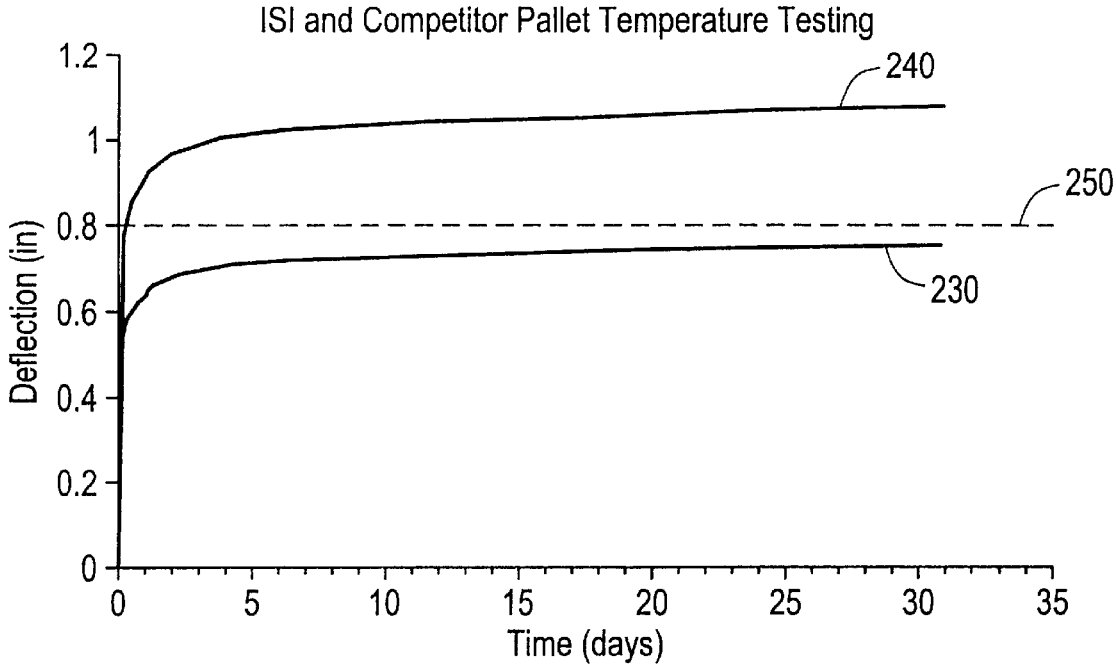
FIGS. 28 and 29 are graphs comparing the amounts of deflection between the pallet as disclosed and a comparative pallet.
Figure 29:
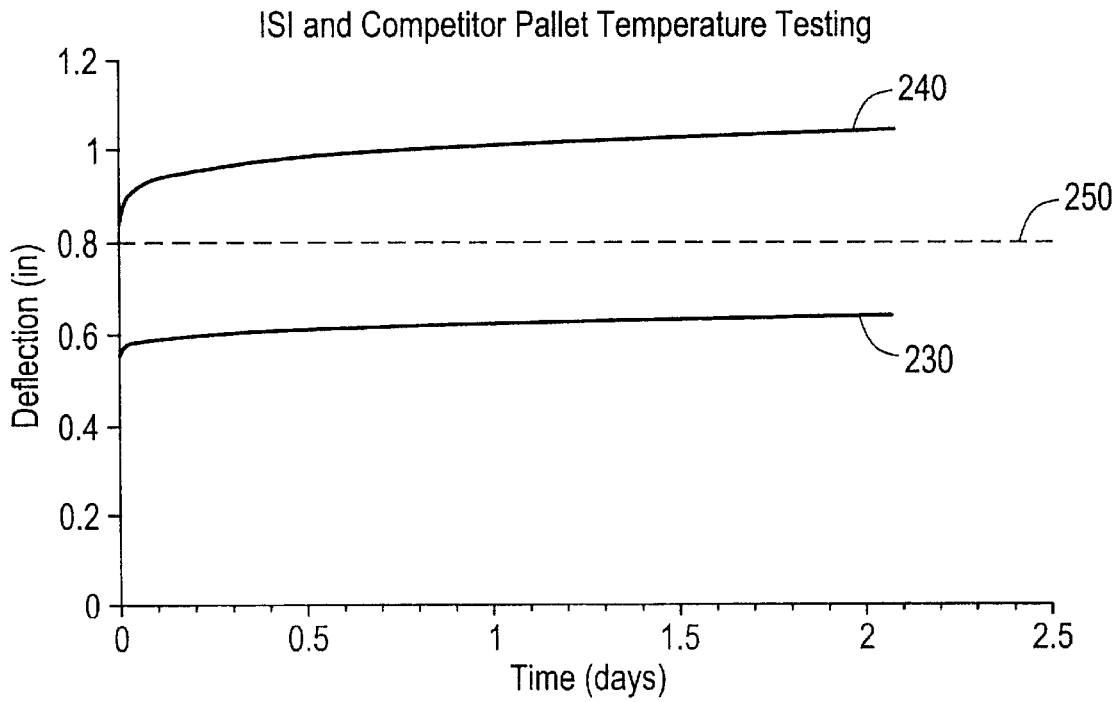

Further testing conducted as shown in FIGS. 28 and 29 comparing a plastic pallet without the support material, foot designs, or other features such as the reinforcement structures and their particular arrangements and configurations to that of the pallet disclosed herein again resulted in the present pallet design being the only pallet passing the deflection test as outlined within the Virginia Tech Protocol. These tests were conducted at 115 degrees Fahrenheit with 2,800 pounds of sand for a period of 30 days in one racked direction and 2 days on the opposite racked direction with extrapolation to 30 days. With reference to FIG. 28, 2,800 pounds of sand racked for about 30 days resulted in a deflection of only 0.754 inches for pallet 10 (below the 0.80 inch limit, line 250, defined by the Virginia Tech Protocol) as shown by line 230, while the competitive pallet in the same test exceeded the limit set by the Virginia Tech Protocol by deflecting 1.083 inches, as shown by line 240. In FIG. 29, 2,800 pounds of sand racked in the opposite direction as was done in FIG. 28 resulted in a deflection of only 0.641 inches for pallet 10 (again below the 0.80 inch limit, line 250, defined by the Virginia Tech Protocol) as shown by line 230, while the comparative pallet in the same test exceeded the limit set by the Virginia Tech Protocol by deflecting 1.039 inches, as shown by line 240. Such results clearly illustrates the superior structural capabilities of pallet 10 over comparative pallets.

While preferred embodiments have been shown and described, various modifications and substitutions may be made thereto without departing from the spirit and scope of the invention. It is to be understood that the present invention has been described by way of illustration and not limitation.

What is claimed is:

1. A pallet comprising:

an upper deck configured from a support material;

an upper frame member supporting said upper deck;

a plurality of foot members disposed in physical contact with said upper frame member; and a lower frame member disposed in physical contact with said plurality of foot members, wherein said upper deck is configured using at least two plates disposed in a spaced relationship except for a portion thereof where facing surfaces defining a surface of each of the at least two plates operably join to form a support element disposed between and connecting said at least two plates, and wherein said support element comprises at least two support members disposed between and normal to said at least two plates.

2. The pallet of claim 1, wherein a second support material is disposed between said at least two plates and said at least two support members.

3. The pallet of claim 2, wherein said support material is selected from the group consisting of plastic, wood, fiberglass, and combinations comprising at least one of the foregoing support materials.

4. The pallet of claim 2, wherein said support material comprises foam.

5. A pallet, comprising:

an upper deck;

a lower frame member arranged in a parallel planar relationship with said upper deck;

a plurality of foot members connected to said upper deck and said lower frame member; and a reinforcement member positioned in physical contact with said upper deck, said reinforcement member comprising, a first plate, a second plate disposed in a spaced relationship with said first plate, and a support element disposed between said first plate and said second, wherein said support element further comprises a support member disposed between and normal to facing surfaces of said first plate and said second plate, said support member includes perforated openings.

6. The pallet of claim 5, wherein said upper deck comprises a composite polymer material.

7. The pallet of claim 6, wherein said composite polymer material comprises, a biaxial weave of fibrous polymer, and a sheet of polymer bonded to said biaxial weave of fibrous polymer.

8. The pallet of claim 7, wherein said biaxial weave of fibrous polymer is selected from the group consisting of polypropylene, polyethylene, and combinations of the foregoing materials.

9. The pallet of claim 7, wherein said biaxial weave of fibrous polymer further comprises an additive selected from the group consisting of fibrous glass, fibrous carbon, UV stabilizing compounds, biocidal compounds, and combinations of the foregoing additives.

10. The pallet of claim 5, wherein said upper deck comprises a non-skid surface.

11. The pallet of claim 5, wherein said openings further comprise a geometric shape selected from the group consisting of circular, substantially circular, oblong, multi-sided, and combinations comprising at least one of the foregoing shapes.

12. The pallet of claim 5, wherein said openings comprise triangular shapes arranged to be alternating in orientation such that a truss pattern is defined thereby, said truss pattern extending along a length of said support members.

13. The pallet of claim 5, wherein said first plate is perforated with openings.

14. The pallet of claim 13, wherein said openings further comprises a geometric shape selected from the group consisting of circular, substantially circular, oblong, multi-sided, and combinations comprising at least one of the foregoing shapes.

15. The pallet of claim 5, wherein said reinforcement member comprises a material selected from the group consisting of steel, aluminum, titanium, chromium, molybdenum, carbon, composites and alloys of the foregoing materials, and combinations comprising at least one of the foregoing materials.

16. The pallet of claim 5, wherein said support element comprises a material selected from the group consisting of foam, plastic, wood, fiberglass, porous ceramic, porous metal, and combinations comprising at least one of the foregoing materials.

17. The pallet of claim 5 further comprising a second reinforcement member positioned in physical contact with said lower frame member.

18. The pallet of claim 5, wherein said reinforcement member comprises a material having a yield strength of greater than or equal to about 50,000 psi.

19. The pallet of claim 5, wherein said reinforcement member further comprises a corrosion prevention material disposed on a surface thereof.

20. The pallet of claim 5 having a weight per unit area based on an upper deck dimension of less than or equal to about 4.5 lb/ft2.

21. The pallet of claim 20, wherein the weight per unit area based on the upper deck dimension is about 2.5 $lb/ft^2$ to about 4.5 $lb/ft^2$.

22. A reinforcement structure disposed within a deck of a pallet, said reinforcement structure comprising:

a first reinforcement member extending from a first edge of the deck to an opposing edge of said deck;

a second reinforcement member extending from a point on said first reinforcement member intermediate ends of said first reinforcement member to an edge of said deck adjacent to said first edge of said deck; and a third reinforcement member extending from a point on said first reinforcement member intermediate ends of said first reinforcement member and opposing the point on said first reinforcement member at which said second reinforcement member extends front to an edge of said deck adjacent to said first edge of said deck and opposing the edge of said deck at which an end of said second reinforcement member is disposed.

23. The reinforcement structure of claim 22, wherein said second reinforcement member and said third reinforcement member are attached to opposing sides of said first reinforcement member.

24. The reinforcement structure of claim 22, wherein said arrangement of reinforcement members is positioned within said deck of the pallet with an angled from an arrangement of reinforcement members positioned within a second deck of said pallet positioned adjacent to and parallel to said deck of said pallet.

25. A reinforcement structure disposed within a deck of a pallet, said reinforcement structure comprising:

a first reinforcement member extending from a first edge of said deck to an opposing edge of said deck; and a second reinforcement member extending from an edge of the deck adjacent and substantially normal to the first edge of the deck, crossing over said first reinforcement member, and extending to an edge of the deck opposing the edge from which said second reinforcement member originates.

26. The reinforcement structure of claim 25, wherein a point at which said first reinforcement member crosses over said second reinforcement member occurs at a point intermediate opposing ends of said first reinforcement member and intermediate opposing ends of said second reinforcement member.

27. The reinforcement structure of claim 25, wherein the point at which said first reinforcement member crosses over said second reinforcement member results in a point having an increased thickness, the point of increased thickness being positioned to be concealable within a foot member disposed adjacent the deck of the pallet.

28. A reinforcement structure disposed within a deck of a pallet, the reinforcement structure comprising:

a structural hub member, said structural hub member being disposable substantially equidistant from edges of the deck; and a plurality of reinforcement members supported at said structural hub member and extendable to the edges of the deck, wherein at least two reinforcement members of the plurality of said reinforcement members have ends defining a length thereof, one end of each being received at said structural hub member.

29. The reinforcement structure of claim 28, wherein said structural hub member comprises a plurality of legs extending radially and planarly therefrom, each of the legs being configured to receive a corresponding reinforcement member from said plurality of reinforcement members.

30. The reinforcement structure of claim 29, wherein each of the legs extending from said structural hub member is configured to receive the corresponding reinforcement member thereover, each of the reinforcement members being retained on the legs.

31. The reinforcement structure of claim 29, wherein each of the legs extending from said structural hub member is configured to receive the corresponding reinforcement member axially into an end thereof, each of the reinforcement members being retained on the legs.

32. A reinforcement structure disposed within a deck of a pallet, the reinforcement structure comprising:

a reinforcement member, said reinforcement member being extendable from a first edge of the deck to an opposing edge of the deck, said reinforcement member comprising a plurality of legs depending from opposing sides of said reinforcement member, each leg of said plurality of legs extending planarly from said reinforcement member; and a plurality of sub-reinforcement members, said plurality of sub-reinforcement members corresponding in number to said plurality of legs depending from opposing sides of said reinforcement member and being supported at said plurality of legs, each sub-reinforcement member of said plurality of sub-reinforcement members have a one end being extendable to the edge of the deck and an opposite end being extendable to a corresponding leg of the plurality of legs.

33. The reinforcement structure of claim 32, wherein the legs of said plurality of legs are configured to receive the corresponding sub-reinforcement member thereover, each of the sub-reinforcement members of said plurality of sub-reinforcement members being retained on the legs.

34. The reinforcement structure of claim 32, wherein the legs of said plurality of legs are configured to receive the corresponding sub-reinforcement member axially therein, each of the sub-reinforcement members of said plurality of sub-reinforcement members being retained on the legs.

35. A reinforcement structure disposed within a deck of a pallet, the reinforcement structure comprising:

a first reinforcement member extendable between opposing edges of the deck, said first reinforcement member having an opening disposed laterally therethrough at a point intermediate opposing ends thereof; and a second reinforcement member received through said opening defined by said first reinforcement member, said second reinforcement member being extendable between opposing edges of the deck.

36. A pallet, comprising:

an upper deck;

a lower frame member arranged in a parallel planar relationship with said upper deck;

a plurality of foot members connected to said upper deck and said lower frame member; and a reinforcement member positioned in physical contact with said upper deck, said reinforcement member comprising, a first plate, a second plate disposed in a spaced relationship with said first plate, and a support element disposed between said first plate and said second plate, wherein said support element comprises a support member disposed between and normal to facing surfaces of said first plate and said second plate, and wherein a support member thickness is different from a first plate thickness or a second plate thickness.

37. The pallet of claim 36, wherein a support member thickness is less than said first plate thickness and said second plate thickness.

38. The pallet of claim 36, wherein said support material comprises foam.

39. A pallet, comprising:

an upper deck;

a lower frame member arranged in a parallel planar relationship with said upper deck;

a plurality of foot members connected to said upper deck and said lower frame member; and a reinforcement member positioned in physical contact with said upper deck, said reinforcement member comprising, a first plate, a second plate disposed in a spaced relationship with said first plate, a support element disposed between said first plate and said second plate, wherein said support element comprises a support member disposed between and normal to facing surfaces of said first plate and said second plate, and a support material is disposed adjacent to said support member.

* * * * *